US010845167B2

(12) United States Patent
Johannaber et al.

(10) Patent No.: US 10,845,167 B2
(45) Date of Patent: Nov. 24, 2020

(54) DISC LAUNCHING DEVICE

(71) Applicant: Consortia Development, Inc., Reno, NV (US)

(72) Inventors: Kenneth D. Johannaber, Reno, NV (US); Michael G. Fisher, Reno, NV (US)

(73) Assignee: CONSORTIA DEVELOPMENT, INC., Reno, NV (US)

( * ) Notice: Subject to any disclaimer, the term of this patent is extended or adjusted under 35 U.S.C. 154(b) by 0 days.

(21) Appl. No.: 16/535,725

(22) Filed: Aug. 8, 2019

(65) Prior Publication Data

US 2019/0360786 A1 Nov. 28, 2019

Related U.S. Application Data

(62) Division of application No. 15/928,980, filed on Mar. 22, 2018, now Pat. No. 10,378,865.

(51) Int. Cl.

| | |
|---|---|
| ***F41J 9/28*** | (2006.01) |
| ***F41B 3/04*** | (2006.01) |
| ***A63B 59/30*** | (2015.01) |
| ***A63H 33/18*** | (2006.01) |
| ***A63B 65/10*** | (2006.01) |
| ***A63B 60/34*** | (2015.01) |

(52) U.S. Cl.

CPC ..... *F41J 9/28* (2013.01); *A63B 59/30* (2015.10); *A63B 60/34* (2015.10); *A63B 65/10* (2013.01); *A63H 33/18* (2013.01); *A63B 2244/03* (2013.01); *A63B 2244/15* (2013.01)

(58) Field of Classification Search

CPC ..... F41J 9/28; F41B 3/00; F41B 3/04; A63B 65/122; A63H 33/18

USPC ..... 124/5

See application file for complete search history.

(56) References Cited

U.S. PATENT DOCUMENTS

| | | | | | |
|---|---|---|---|---|---|
| 1,607,874 | A * | 11/1926 | Darton | F41J 9/28 | 124/5 |
| 1,700,880 | A * | 2/1929 | Camp | F41J 9/28 | 124/5 |
| 2,122,984 | A * | 7/1938 | Loomis | F41J 9/28 | 124/5 |

(Continued)

OTHER PUBLICATIONS

Invitation to Pay Additional Fees for International Application No. PCT/US2019/020200, dated Jul. 29, 2019, 16 pages.

(Continued)

*Primary Examiner* — Alexander R Niconovich

(74) *Attorney, Agent, or Firm* — Merchant & Gould P.C.

(57) ABSTRACT

A disc launching device includes a long handle and a disc holder at one end of the handle. The handle may include a grip end for holding the handle, an attachment end opposite the grip end, and a shaft extending from the grip end to the attachment end. The disc holder is attached to the attachment end of the handle. It includes a front rail for holding one side of a disc, a back rail for holding an opposite side of the disc, and at least one support member extending between the front rail and the back rail. The front rail and the back rail form an opening on one side of the disc holder, configured to allow the disc to launch out of the disc holder through the opening when sufficient forward momentum is applied to the disc holder via the handle.

10 Claims, 30 Drawing Sheets

(56) References Cited

U.S. PATENT DOCUMENTS 2,124,738 A * 7/1938 Johnsen ..... F41J 9/28 124/5
3,537,438 A * 11/1970 Reed ..... F41J 9/28 124/5
3,901,208 A * 8/1975 Laporte ..... F41J 9/28 124/5
4,076,004 A * 2/1978 Huelskamp ..... F41J 9/28 124/5
4,170,215 A * 10/1979 Kettlestrings ..... F41B 7/08 124/16
4,222,361 A * 9/1980 Jackson ..... F41B 3/00 124/5
4,233,952 A * 11/1980 Perkins ..... F41B 3/00 124/5
4,347,828 A * 9/1982 Bridgeman ..... F41B 3/04 124/5
4,730,595 A * 3/1988 Glass ..... F41J 9/28 124/5
4,974,574 A * 12/1990 Cutlip ..... F41B 3/00 124/5
4,984,556 A * 1/1991 Glass ..... F41B 3/00 124/42
7,665,453 B1 * 2/2010 D'Agostino ..... A63H 33/18 124/5
7,665,454 B1 * 2/2010 D'Agostino ..... F41B 3/04 124/5
7,895,995 B2 * 3/2011 Simon ..... A01K 15/025 124/5
7,900,617 B1 * 3/2011 Kersh ..... F41J 9/30 124/5
8,387,601 B1 * 3/2013 Christensen ..... A63B 60/34 124/5
8,511,292 B2 8/2013 Black
8,539,939 B2 * 9/2013 Minneman ..... A01K 15/025 124/5
9,522,315 B2 * 12/2016 Ruyssenaars ..... A63B 67/06
10,004,209 B2 * 6/2018 Hartelius ..... A01K 15/025
10,195,503 B1 * 2/2019 Lesh ..... F41B 3/00
10,378,865 B1 * 8/2019 Johannaber ..... A63B 65/10
2005/0070198 A1 * 3/2005 Pickering ..... A63H 27/14 446/71
2012/0199105 A1 * 8/2012 Smit ..... A63B 65/122 124/5
2012/0210989 A1 * 8/2012 Black ..... F41J 9/28 124/5
2013/0174818 A1 * 7/2013 Tingey ..... F41J 9/28 124/5
2016/0040951 A1 * 2/2016 Griffin ..... F41B 3/04 124/5
2016/0096095 A1 * 4/2016 Williams ..... A63B 65/122 124/5

OTHER PUBLICATIONS

International Search Report and Written Opinion for International Application No. PCT/US2019/020200, dated Sep. 19, 2019, 20 pages.

* cited by examiner

DISC LAUNCHING DEVICE

CROSS-REFERENCE TO RELATED APPLICATIONS

This application is a divisional of U.S. patent application Ser. No. 15/928,980, filed Mar. 22, 2018, entitled, "DISC LAUNCHING DEVICE," now U.S. Pat. No. 10,378,865, which is hereby incorporated by reference in its entirety into the present application.

TECHNICAL FIELD

This application is directed generally to field of sports and leisure equipment. More specifically, the application describes a disc launching device used to throw a disc for sport or leisure.

BACKGROUND

Analysts forecast the multi-billion-dollar sports equipment market to grow to over $80 billion by 2020. Product improvement and an emergence of e-commerce will continue to fuel growth of the sports equipment market. Additionally, baby boomers continue to be active and enthusiastic participants in leisure sports requiring sports equipment. Sports equipment product designs are often tailored to specific user capabilities, and the baby boomer generation is the largest segment of the leisure sports population.

Tossing a disc (or flying saucer) was popularized by the "Frisbee," released by the Wham-O company over 50 years ago. Several laws of physics come into play for a human to propel a flying disc by hand, and several articulating joint groups are used to propel a flying disc, including the shoulder, elbow and wrist joints. Forward momentum is generated by a backhand or forehand throwing motion of the arm and a final snap of the wrist, while releasing the flying disc provides spin and gyroscopic stability, which allow the disc to fly more efficiently (without wobble) before gravity finally pulls the disc down to earth. The faster the throwing motion and wrist snap, the farther the flying disc will fly.

Throwing a flying disc by hand is a well-known pastime, requiring a certain level of athleticism, coordination, and mobility. However, not everyone possesses the skill and mobility to throw a flying disc consistently or with a desired trajectory and distance. Additionally, throwing a flying disc by hand can often cause pain or soreness, specifically in the shoulder, elbow, and wrist.

Therefore, it would be advantageous to have a device, system and method for propelling a flying disc accurately and efficiently. Ideally, such a device, system and method would allow for easy, simple throwing of a disc, while reducing the stress placed on the thrower's shoulder, elbow, and wrist.

BRIEF SUMMARY

In one aspect of the present disclosure, a disc launching device includes a handle, a disc holding housing coupled with the handle, and a disc retention arm moveably coupled with the disc holding housing. In some embodiments, the handle may be moveably coupled to the disc holding housing, and the disc retention arm may be fixed within the disc holding housing.

The handle has a first end and a second end, with a handle grip portion disposed at the first end of the handle, and with the disc holding housing disposed at the second end of the handle. In some embodiments, the handle has a U-shaped groove at or near the second end of the handle for attachment of the disc holding housing. Also, in some embodiments, the second end of the handle has a rectangular or square boss projecting from at or near the second end of the handle for attachment of the disc holding housing.

The disc holding housing is comprised of a front rail, a back rail, a top support, a bottom support, and an aperture for housing a disc through and between the rails and supports. The disc holding housing is moveably coupled to the second end of the handle and may be positioned parallel to the long axis of the handle, perpendicular to the long axis of the handle, or at an angle between parallel and perpendicular to the long axis of the handle. In some embodiments, the disc holding housing is un-moveably attached to the second end of the handle and may be manufactured as a monolithic handle/disc holding housing.

In one embodiment, the disc holding housing is comprised of a disc retention arm with a high-friction portion of the disc retention arm providing mechanical resistance or pinch on the disc, and further comprised of an adjustable disc retention arm adjustment slider moveably attached to the front rail of the disc holding housing. In other embodiments, the disc retention arm and disc retention arm adjustment slider may be attached to the back rail of the disk holding housing. And in yet other embodiments the disc retention arm may be an un-moveable protuberance attached to, or part of the front or back rails of the disc holding housing.

In another aspect of the disclosure, a method for throwing a flying disc may involve a thrower holding the first end of the handle and grabbing the second end of the handle and positioning the disc holding housing perpendicular to the long axis of the handle, scooping the disc off of the ground into the aperture within the disc holding housing, lifting the disc within the disc holding housing above the thrower's waist level for easy viewing, moving the position of the disc holding housing's aperture parallel to the long axis of the handle, adjusting the disc retention arm slider to the thrower's preferred location, and swinging the handle of the disc launching device, creating forward momentum and elastic potential energy at the interface of the disc and the disc retention arm until such moment in time the elasticity of disc retention arm yields and the disc releases parallel to the top support arm and bottom support arm exiting the disc holding housing aperture and takes gyroscopically stable flight.

In one aspect of the present disclosure, a disc launching device includes a handle and a disc holder. The handle includes a grip end for holding the handle, an attachment end opposite the grip end, and a shaft extending from the grip end to the attachment end. The disc holder is attached to the attachment end of the handle and includes a front rail for holding one side of a disc, a back rail for holding an opposite side of the disc, and at least one support member extending between the front rail and the back rail. The front rail and the back rail form an opening on one side of the disc holder, configured to allow the disc to launch out of the disc holder through the opening when sufficient forward momentum is applied to the disc holder via the handle.

In some embodiments, the handle is moveable relative to the disc holder from a loading configuration, in which a longitudinal axis of the handle is angled relative to a longitudinal axis of the disc holder, and a throwing configuration, in which the longitudinal axis of the handle is parallel to the longitudinal axis of the disc holder. Such embodiments may further include a locking member to lock the handle relative to the disc holder in the throwing configuration. The locking member may optionally also be configured to lock the handle relative to the disc holder in the loading configuration.

In some embodiments, each of the front rail and the back rail includes a top portion and a bottom portion, and an edge of the disc fits between the top portion and the bottom portion of the front rail and the back rail. In some embodiments, an inner surface of each of the front rail and the back rail, between the top portion and the bottom portion, has an inward facing V-shape. the top portion and the bottom portion of the front rail and the back rail are configured to grip the disc between them, and wherein the sufficient amount of forward momentum deflects at least one of the top portion or the bottom portion to allow the disc to launch from the opening in the disc holder. In some embodiments, the disc launcher may also include an inner deflection member disposed in the front rail, between the top portion and the bottom portion, where the inner deflection member deflects outward when the disc is launched. In some embodiments, the inner deflection member is removable. The disc launcher may also include multiple additional inner deflection members, where the inner deflection member and the additional inner deflection members have different sizes to allow the disc launching device to accommodate differently sized discs.

In some embodiments, the front rail may be longer than and/or more curved than the back rail. In some embodiments, the front rail may include a deflection member for providing friction between the front rail and the disc, to generate spin in the disc when it is thrown. The disc launcher may also include at least one adjustment member disposed on the front rail, for adjusting an amount of holding force applied to the disc with the deflection member and thus adjusting an amount of launching force required to launch the disc out of the opening. In some embodiments, for example, the adjustment member may be an adjustment slider that slides along a top of the front rail from a least force position to a greatest force position.

In some embodiments, the opening in the disc holder is smaller than a maximum diameter of the disc, and one end of the front rail deflects to allow the disc to launch out of the opening when the sufficient forward momentum is applied to the disc launching device. The front rail may have an inner, disc holding surface that is curved, and the back rail may have an inner, disc holding surface that is straight. In some embodiments, the inner, disc holding surface of each of the front rail and the back rail is V-shaped. The handle may extend from the disc holder at an oblique angle relative to the throwing direction of the disc. Some embodiments may include only a top support member, while alternative embodiments also include a bottom support member.

In another aspect of the present disclosure, a method for launching a disc, using a disc launching device, involves holding a grip end of a handle of the disc launching device, grasping the disc with a disc holder coupled with an attachment end of the handle at an opposite end of an elongate shaft of the handle, and swinging the handle of the disc launching device with sufficient forward momentum to cause the disc to launch out of an opening in the disc holder. In some embodiments, the disc holder includes a top support member, and grasping the disc involves advancing a front rail of the disc holder over one side of the disc and snapping a back rail of the disc holder over an opposite side of the disc. In an alternative embodiment, the disc holder includes a top support member and a bottom support member, and grasping the disc involves sliding the disc into the disc holder between the top support member and the bottom support member. In such an embodiment, the opening in the disc holder may be located at a front of the device, and grasping the disc may involve sliding the disc into a corresponding back opening in a back of the disc holder.

Optionally, the method may also include, before swinging the handle, moving the handle relative to the disc holder from a loading configuration, in which a longitudinal axis of the handle is angled relative to a longitudinal axis of the disc holder, to a throwing configuration, in which the longitudinal axis of the handle is parallel to the longitudinal axis of the disc holder. The method may also include locking the handle relative to the disc holder in the throwing configuration, in which the longitudinal axis of the handle is parallel to the longitudinal axis of the disc holder.

Swinging the handle of the disc launching device with sufficient forward momentum may involve deflecting a deflection member on a disc contact surface of the front rail to allow the disc to launch out of the opening in the disc holder. In some embodiments, the method may also include adjusting an adjustment member coupled with the front rail, to adjust an amount of force with which the deflection member holds the disc and thus adjust an amount of force required to be applied to the launching device to launch the disc. For example, adjusting the adjustment member may involve sliding a slider along the front rail between a least force position and a greatest force position. Some embodiments of the method may further involve removing the deflection member from the front rail and attaching a replacement deflection member to the front rail, where the deflection member and the replacement deflection member have different sizes to accommodate different sizes of discs in the disc launching device.

In another aspect of the present disclosure, a disc launching system may include the disc launcher as described above, with first and second inner deflection members for the front rail. The first and second inner deflection members are interchangeable in the front rail, and they have different heights to accommodate different disc with different diameters. The system may include third, fourth and any additional suitable numbers of deflection members to accommodate any number of disc sizes.

These and other aspects and embodiments will be described in further detail below, in relation to the attached drawing figures.

DETAILED DESCRIPTION

Described herein is a disc launching device, system and method, for launching a sports disc, commonly referred to as a "Frisbee." The device, system and method may be used, in various embodiments, to launch any size, shape and weight of disc. For example, in disc golf, players often switch between different sizes and weights of discs during a round. In some embodiments described herein, the disc launching device is adjustable to accommodate such variations in disc dimensions. Additionally, the device, system and method may also be used, or adapted for use, to launch any other type of disc, such as a disc-shaped clay target used in skeet shooting. Thus, the device, system and method herein is not limited to launching any particular type, size, shape or weight of disc.

Figure 1A:
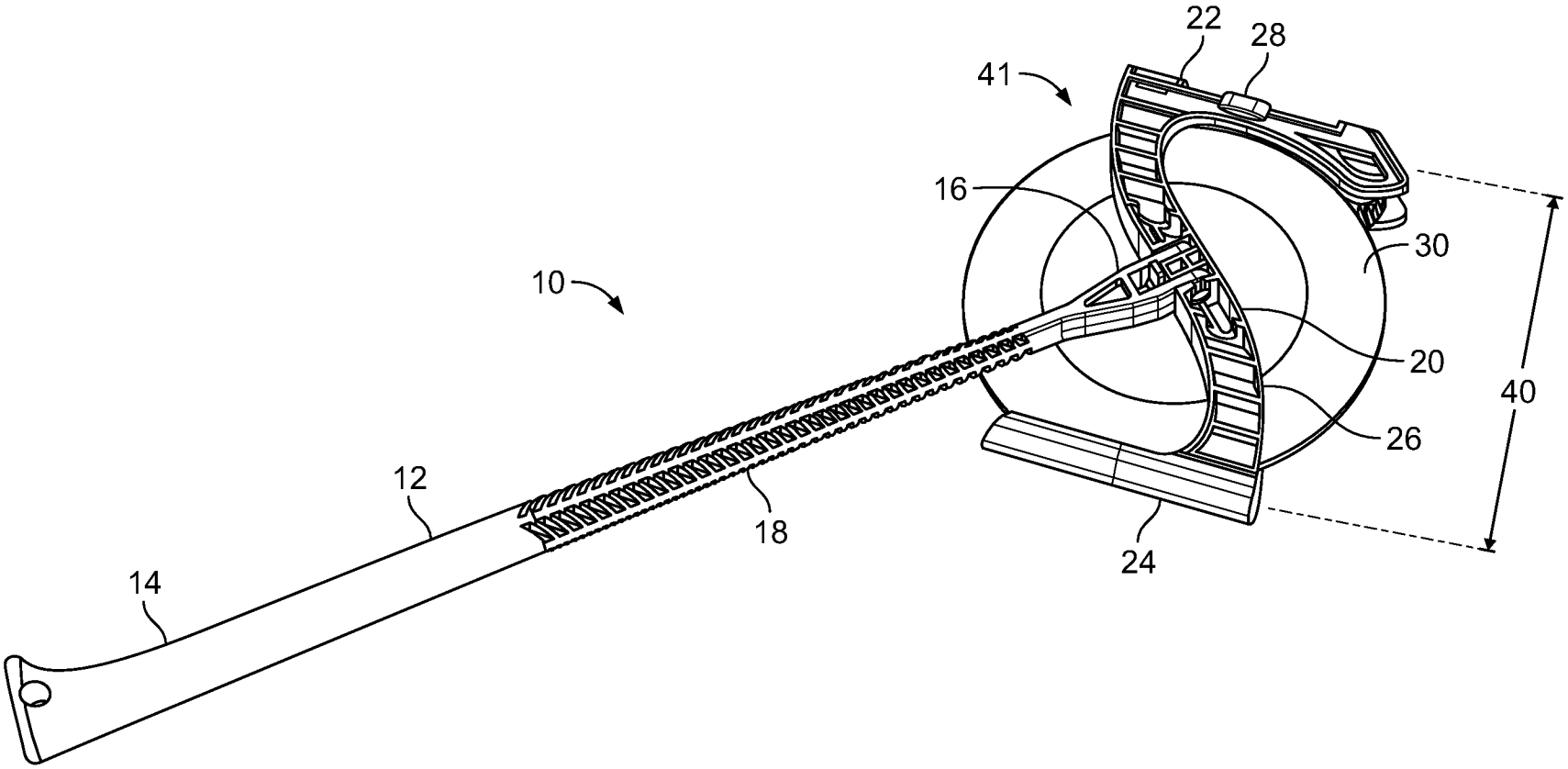
FIGS. 1A and 1B are top perspective and bottom perspective views, respectively, of a disc launching device, according to one embodiment.

Referring now to FIGS. 1A-1J, one embodiment of a disc launching device 10 (or simply "disc launcher") is shown. As illustrated in FIG. 1A, the disc launcher 10 includes a handle 12 and a disc holder 20, each of which may include multiple sections, portions or parts. In this embodiment, the handle 12 is an elongate, one-piece construction having a grip portion 14 (or "grip end") for holding with a hand, an attachment end 16 (or "attachment portion") for attaching to the disc holder 20, and a shaft 18 extending between the two ends 14, 16. The disc holder 20 includes a front rail 22, a back rail 24, and at least a top support member 26 extending between the two rails 22, 24. Optionally, the disc holder 20 may also include an adjustment member 28, for adjusting an amount of holding force applied to the disc 30 by the front rail 22. All of these various features are described in greater detail below.

Also shown in FIG. 1A is a front opening 40 of the disc holder 20. The size or width of the front opening 40 is labeled in FIG. 1A, and it is out of the front opening 40 that the disc 30 is launched. The disc holder 20 also includes a back opening 41, which is used for loading the disc 30 into the disc holder 20. In this embodiment, the user slides the disc 30 into the back opening 41 and then swings the disc launcher 10 via the handle 12 with sufficient force to launch the disc 30 out of the front opening 40. The size of the front opening 40 is smaller than the diameter of the disc 30, so that the front opening 40 deflects, when sufficient swinging/launching force is applied, to allow the disc 30 to eject/launch out of the front opening 40. This process is described in further detail below.

In general, the handle 12 and the disc holder 20 of the disc launching device 10 are configured to work together to hold the disc 30 and allow a thrower to swing the handle with sufficient forward momentum to launch the disc 30 out of the disc holder 20 in a successful disc throw. A number of different forces come into play in launching any disc 30, and more specifically in launching a disc 30 from the disc launcher 10. Aerodynamic lift, for example, is based on the Bernoulli Principle, the relationship between the velocity, pressure, and height of a fluid at any point in the same stream line. Fluids flowing at fast velocity have lower pressure than fluids flowing at a slower velocity. Drag force also comes into play and is related to the viscosity/density of air and the velocity of the throw (or velocity of fluid relative to the disc). Angular momentum, which creates gyroscopic stability, is another important force. The aerodynamic forces acting on the disc 30 are not directly centered on the disc 30. Rather, the lift on the front half of the disc 30 is slightly larger than the lift on the back half, which causes a torque on the disc 30. If the flying disc 30 were not spinning, this torque would flip the front of the disc 30 up and stable flight would be lost (distance decreased). The greater the spin (faster the rotation), the greater the angular momentum and the decreased effect this torque has on the disc 30. This may be referred to as "gyroscopic stability," as it results in a more stable flight.

One of the advantages the disc launcher 10 may provide, as compared to throwing a disc 30 by hand, is a longer moment arm provided by the long handle 12, which translates into greater forward velocity and greater angular momentum. Additionally, the friction-generating front rail 22 leads to greater angular momentum. Furthermore, the two rails 22, 24 together make the disc release angle (or "angle of attack") more consistent than when thrown by hand, resulting in greater stability. These are only some of the advantages of the disc launcher 10, others of which are discussed below.

The handle 12 has a relatively simple construction and may, in alternative embodiments, have any suitable variations in size, shape and materials. For example, the handle 12 may have any suitable length and width, although in most embodiments the handle 12 will have at least a sufficient length to facilitate generation of sufficient disc launching force by the user swinging his or her arm. Similarly, the grip portion 14 may have any suitable shape, for example any number of ergonomic shapes to provide comfortable gripping. The shaft 18 may have grooves, notches, designs or any other features, as desired. The attachment end 16 will be described further below, but in this embodiment has a U-shaped end for attaching to the disc holder 20. The handle 12 may be made of any suitable material, and various embodiments may have different amounts of stiffness or rigidity. Suitable materials may include, but are not limited to, plastic, rubber, various polymers, carbon-fiber composites, wood, metal or combinations thereof. In some embodiments, the handle 12 is one piece, while in other embodiments it may be multiple pieces attached together. In some embodiments, the lengths of the handle 12 and the grip portion 14 may be appropriate for either single-handed throwing or two-handed throwing. In some embodiments, the grip portion 14 of the handle may be very stiff, while the attachment end 16 may have more flexibility, relative to the grip portion 14. This combination of flexibility/stiffness may help facilitate the snapping motion used to release the disc. In other embodiments, however, the handle 12 may be equally stiff along its entire length.

In the illustrated embodiment, the handle 12 is attached to the disc holder 20 at an oblique angle, relative to the front opening 40. In this embodiment, for example, the handle 12 is attached at approximately a 135-degree angle, relative to the front opening 40. In various embodiments, the angle may be vary from about 90 degrees to about 180 degrees. In general, changing the angle simply changes where along the swing stroke the disc leaves the disc launcher 10. The 135 degree angle may be an ideal angle for enabling a user of the device 10 to generate a straight throw. In alternative embodiments, however, any of a number of suitable oblique angle connections of greater than 90 degrees, such as but not limited to about 110 degrees to about 150 degrees for example, may be advantageous for allowing a user to generate swinging force in the handle 12 and have that force translate into a successful, straight launch of the disc 30.

Figure 1B:
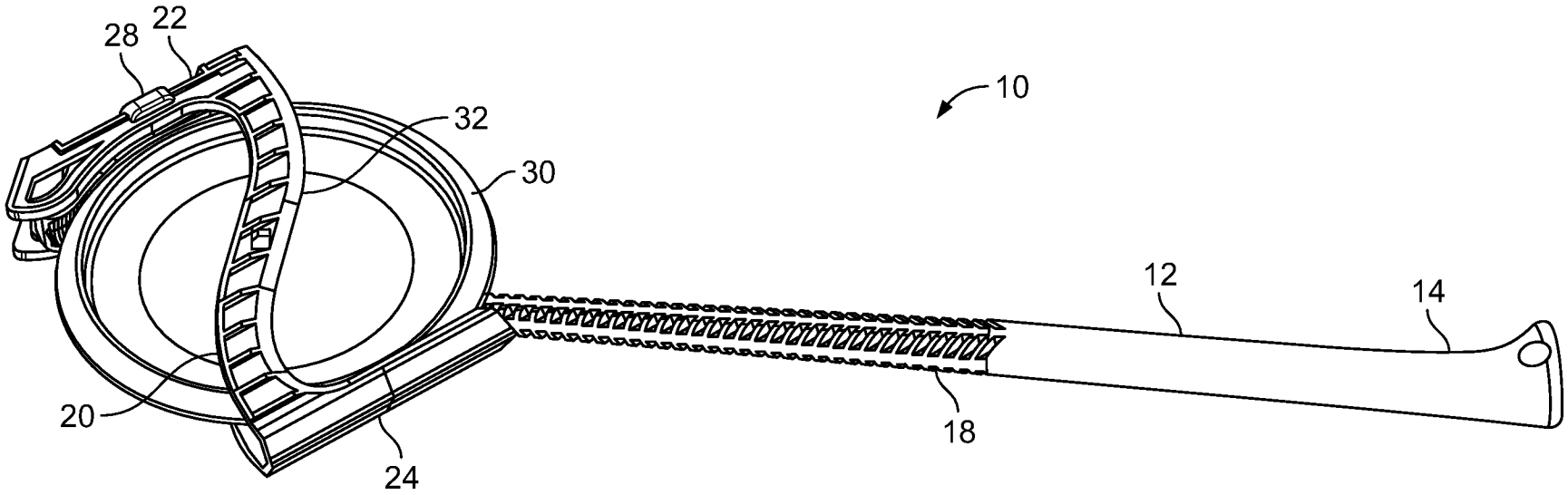

Referring now to FIG. 1B, a bottom view of the disc launching device 10 is provided. This view shows a bottom support member 32, which together with the top support member 26 (shown in FIG. 1A) connects the front rail 22 to the back rail 24. The front rail 22 and the back rail 24 also have top and bottom portions, which are joined together and which contact and hold top and bottom surfaces of the disc 30. Thus, as will be shown in subsequent figures, the disc holder 20 contacts and applies holding force to the disc 30 in two different ways. First, the front rail 22 and the back rail 24 contact the outer edge of the disc 30 and apply inwardly directed force to the disc 30 to hold it. This may be referred to as "vertical force," where the vertical direction is in reference to viewing the disc holder 20 from a top view, with the front rail 22 thus on "top" and the back rail 24 on the "bottom," relative to the disc 30. Second, the top and bottom of the front rail 22 and the back rail 24 contact the top and bottom surfaces of the disc 30 and apply gripping force in that way as well. This force may be referred to as a "pinching force," since the disc is "pinched" between top and bottom portions of the front rail 22 and the back rail 24. To launch the disc 30 out of the front opening 40, the user must swing the handle 12 with sufficient force to overcome these vertical and pinching forces and partially deflect portions of the disc holder 20.

In alternative embodiments, one of which is illustrated in subsequent figures, the disc launcher 10 may include only a top support member 26 and not a bottom support member 32. Thus, only one support member 26 is required, although there may be advantages to having a top support member 26 and a bottom support member 32.

Figures 1C, 1D, 1E:
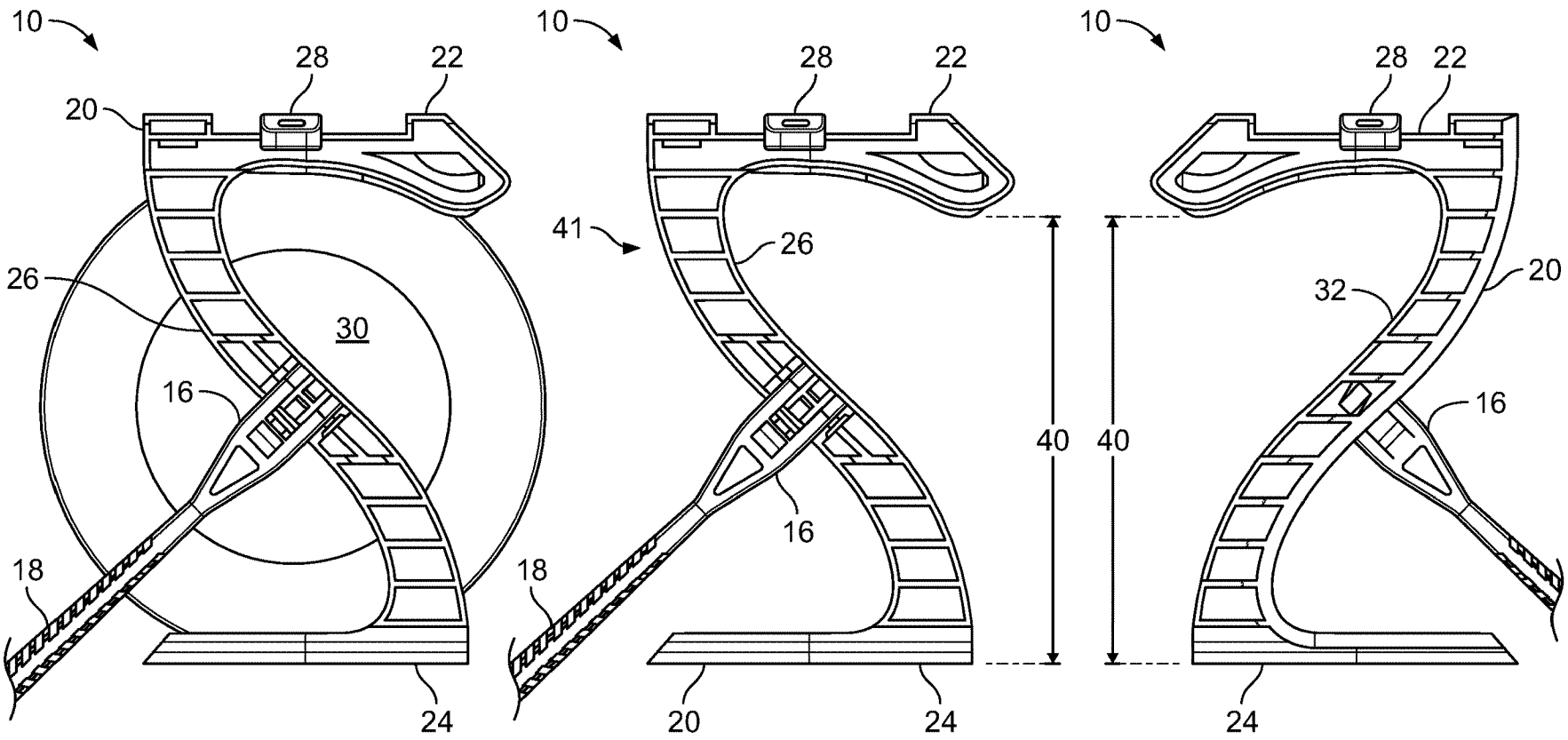
FIGS. 1C and 1D are top views of a disc holder and distal portion of a handle of the disc launching device of FIGS. 1A and 1B, with FIG. 1C including a disc.
FIG. 1E is a bottom view of the disc holder and distal handle portion of FIGS. 1C and 1D.

FIGS. 1C and 1D are top views of a portion of the disc launching device 10, including the disc holder 20 and the distal portion of the handle 12, with FIG. 1C also showing the disc 30. FIG. 1E is a bottom view of the same portion of the disc launcher 10. These figures simply show the disc holder 20 in more detail. As will be explained further in subsequent drawings, the adjustment member 28, which in this example is an adjustment slider 28, is used to adjust the amount of holding force applied to the disc 30 by the disc holder 20. The adjustment slider 28 is coupled with a deflection member (not visible in these figures, but located inside the front rail 22). When the adjustment member 28 is moved all the way forward, closest to the front opening 40, the holding force is maximized, and the swinging/launching force required to launch the disc 30 is also maximized. This greater amount of force will typically translate to launching the disc 30 with more spin and for a longer disc throw. When the adjustment slider 28 is moved to the other end of the front rail 22, closest to the back opening 41, the amount of holding force and required launching force is minimized. This typically translates to less spin and a shorter throw.

Figure 1F:
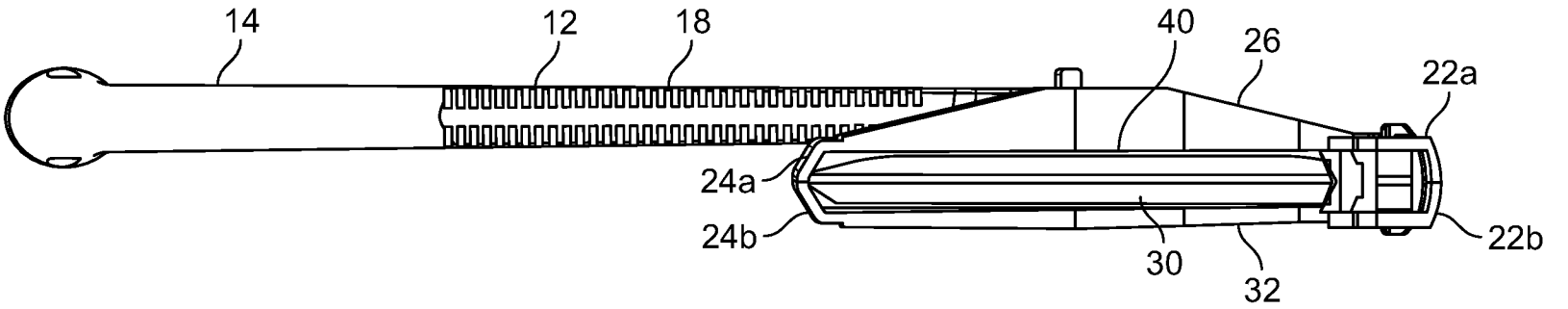
FIGS. 1F and 1G are front side views of the disc launching device of FIGS. 1A-1E, with FIG. 1F including a disc.
Figure 1G:
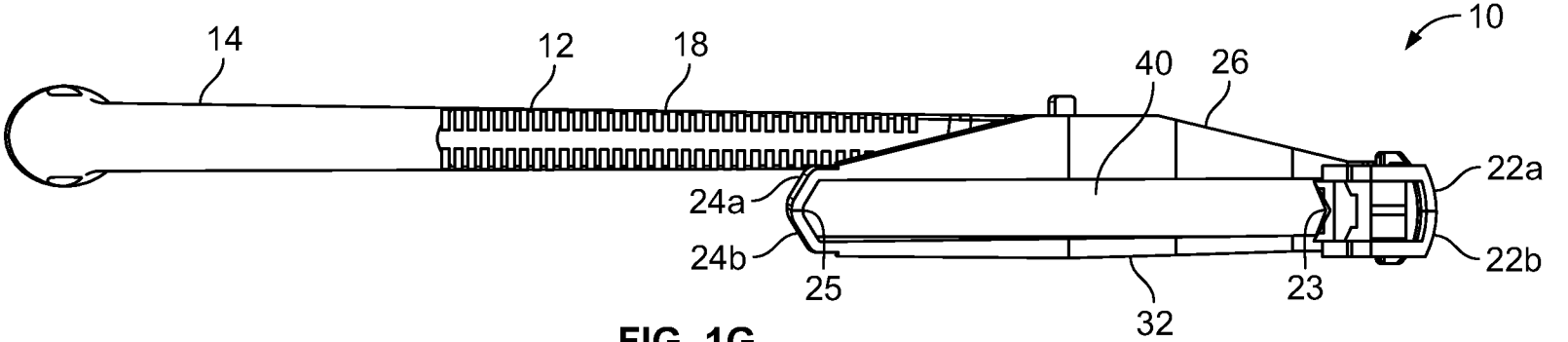
Figure 1H:
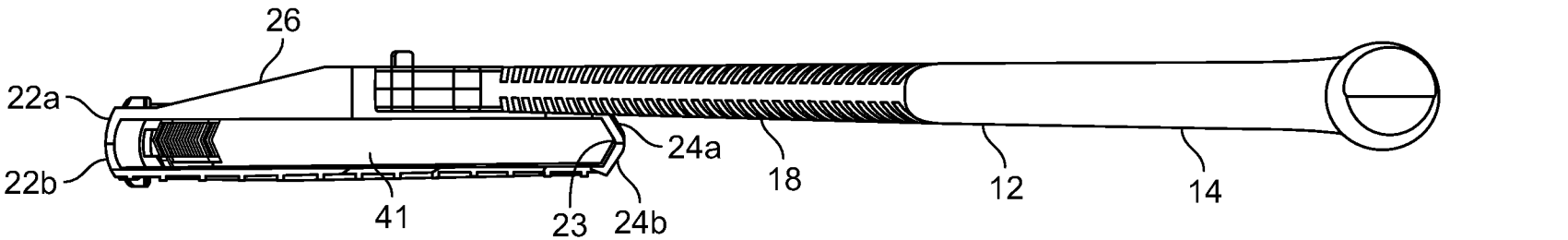
FIG. 1H is a back side view of the of the disc launching device of FIGS. 1A-1G.

Referring now to FIGS. 1F-1H, three side views of the disc launcher 10 are provided. FIG. 1F is a front side view, showing the front opening 40, with a disc 30 residing in the disc holder 20. FIG. 1G is the same as FIG. 1F but with the disc 30 removed. FIG. 1H is a back side view, showing the back opening 41 with no disc 30. FIGS. 1F-1H all show how a front rail top portion 22*a* and a front rail bottom portion 22*b* come together to form an inner surface 23 that is V-shaped. Similarly, a back rail top portion 24*a* and a back rail bottom portion 24*b* come together to form an inner surface 25 that is V-shaped. These V-shaped inner surfaces 23, 25 are shaped and sized to contact and hold the disc 30. Different embodiments of the disc launcher 10 may include disc holders 20 with different opening widths, to accommodate different sizes of discs 30. In some embodiments, as will be explained below, the size of disc holder 20 may also be adjustable, to accommodate different disc sizes with the same disc launcher 10.

Figures 1I, 1J:
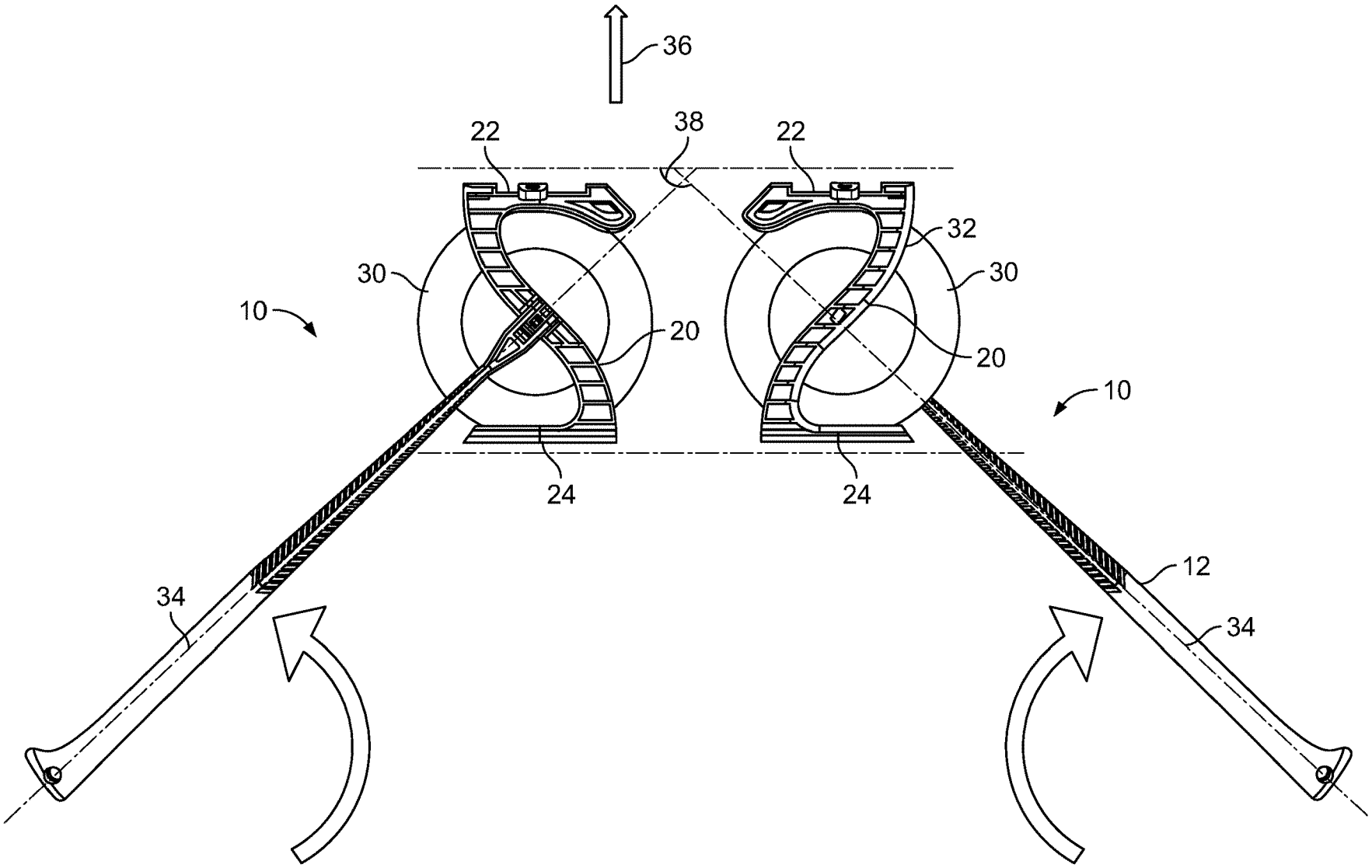
FIGS. 1I and 1J are top and bottom views, respectively, of the disc launching device of FIGS. 1A-1H, illustrating swinging directions and disc launching directions of a right-handed throw (FIG. 1I) and a left-handed throw (FIG. 1J)

Referring now to FIGS. 1I and 1J, a top view and a bottom view of the disc launcher 10, respectively, are provided. These figures illustrate that the disc launching device 10 ambidextrous, meaning it can be used by a right-handed person or a left-handed person. To throw with the left hand, as illustrated in FIG. 1J, the user simply flips the disc launcher 10 over, so the bottom of the disc launcher 10 faces up. These figures illustrate the longitudinal axis of the handle 12 and the oblique angle 38 between the handle longitudinal axis 34 and the launching direction 36 of the disc 30. The large curved arrows at the bottom of the figures illustrate the direction in which the user swings the handle 12 to launch the disc 30.

Figure 2:
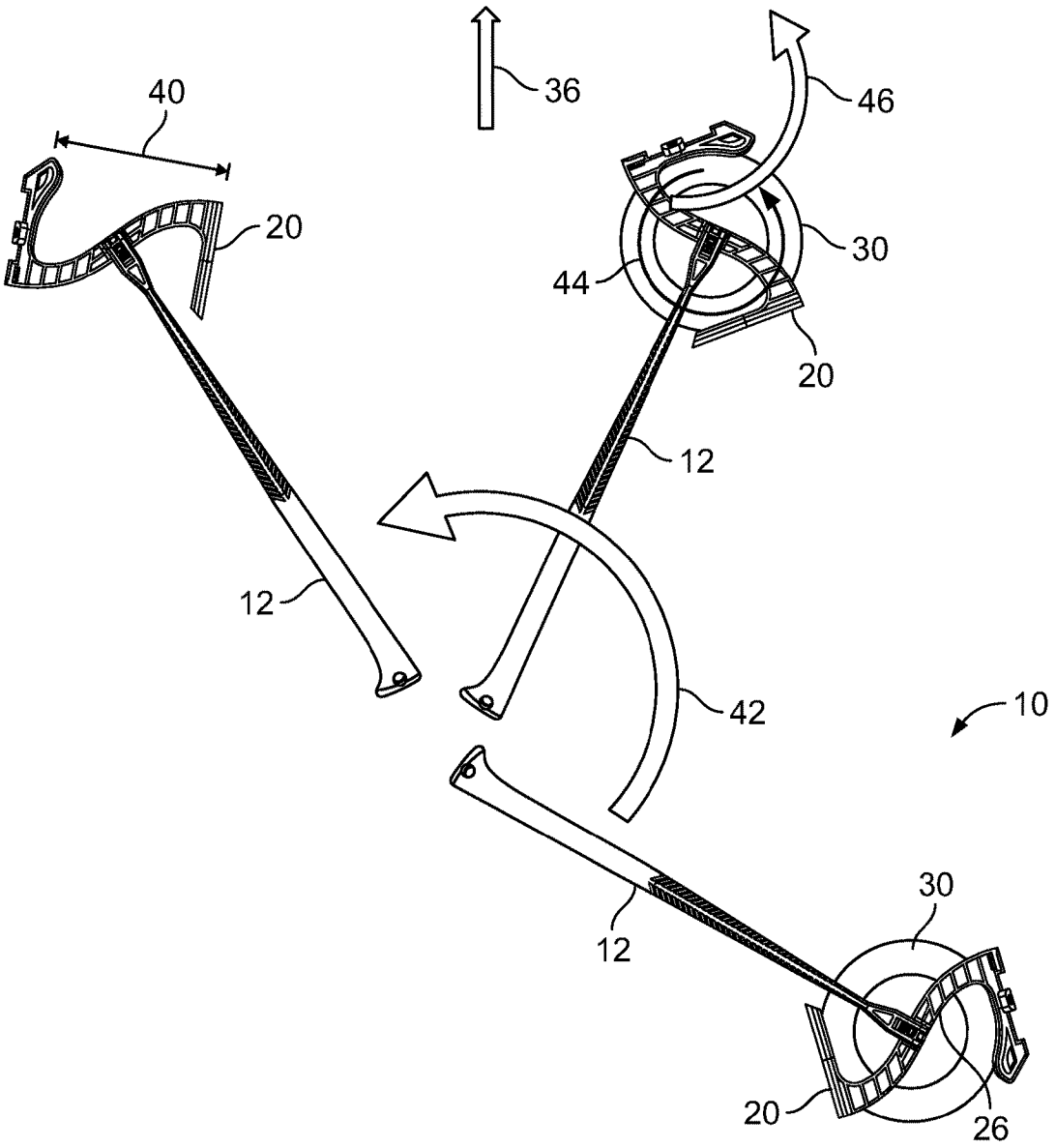
FIG. 2 is three top views of the disc launching device of FIGS. 1A-1J, illustrating a right-handed throwing motion and launching direction, according to one embodiment.

With reference to FIG. 2, a right-handed throw is illustrated in further detail. This figure shows the right-handed swing direction 42, the disc throw direction 36, the disc rotation direction 44, and the disc exit direction 46. The bottom-most portion of the figure shows the disc launcher 10 in a pre-swing or backswing position. The middle portion shows the disc launcher 10 just as the disc 30 about to exit the front opening 40. The left-most portion of the figure shows the disc launcher 10 in a follow through position. Thus, FIG. 2 illustrates the various forces and spins generated during a right-handed throw.

Figure 3:
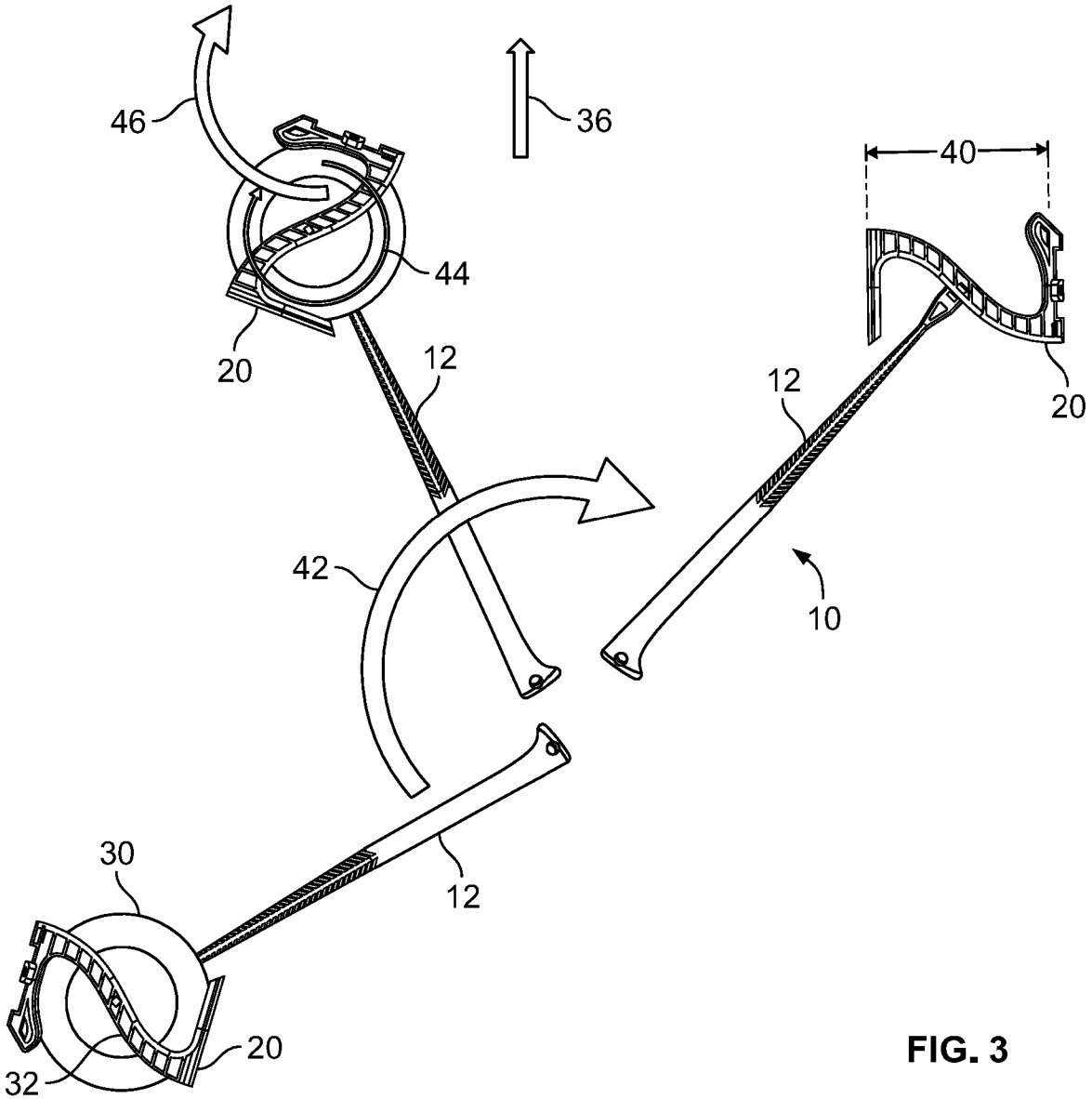
FIG. 3 is three top views of the disc launching device of FIGS. 1A-1J, illustrating a left-handed throwing motion and launching direction, according to one embodiment.

FIG. 3 is simply a reversed version of FIG. 2, illustrating a left-handed throw. Again, the swing direction 42, disc throw direction 36, disc rotation direction 44, and disc exit direction 46 are all illustrated with arrows. And again, to accomplish the left-handed throw, the disc launcher 10 is simply flipped over, so the bottom support member 32 is on top, and the disc is loaded so that the top of the disc is facing up.

Figure 4A:
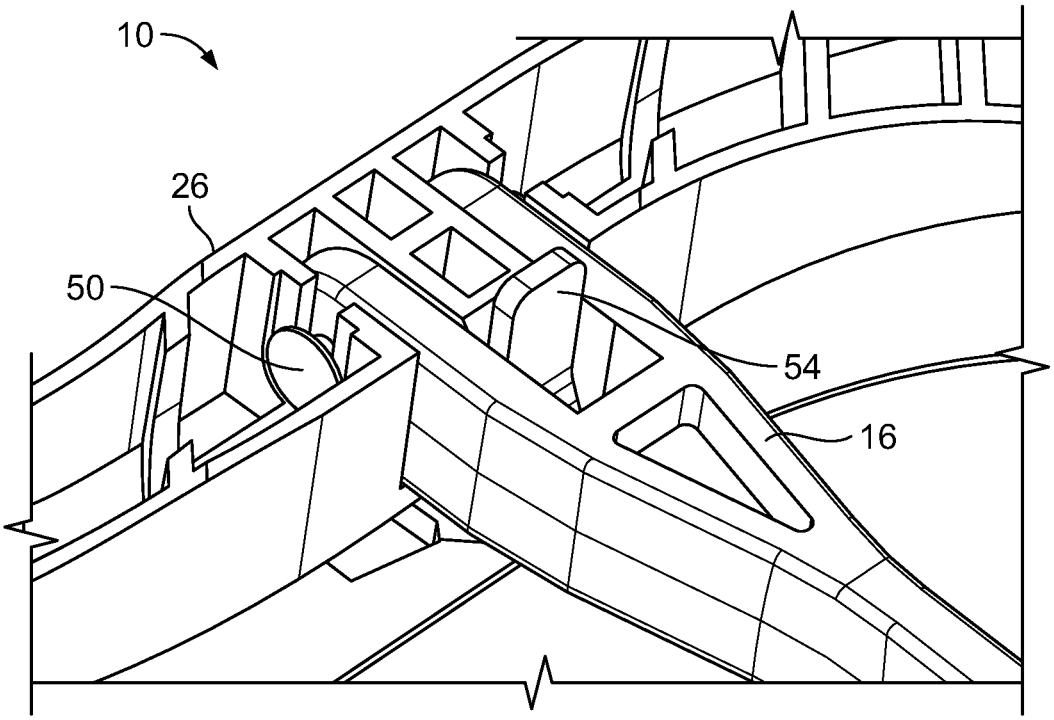
FIGS. 4A and 4B are top perspective and side cross-sectional views, respectively, of an attachment portion of a handle connected to a top support member of a disc launching device, according to one embodiment.
Figure 4B:
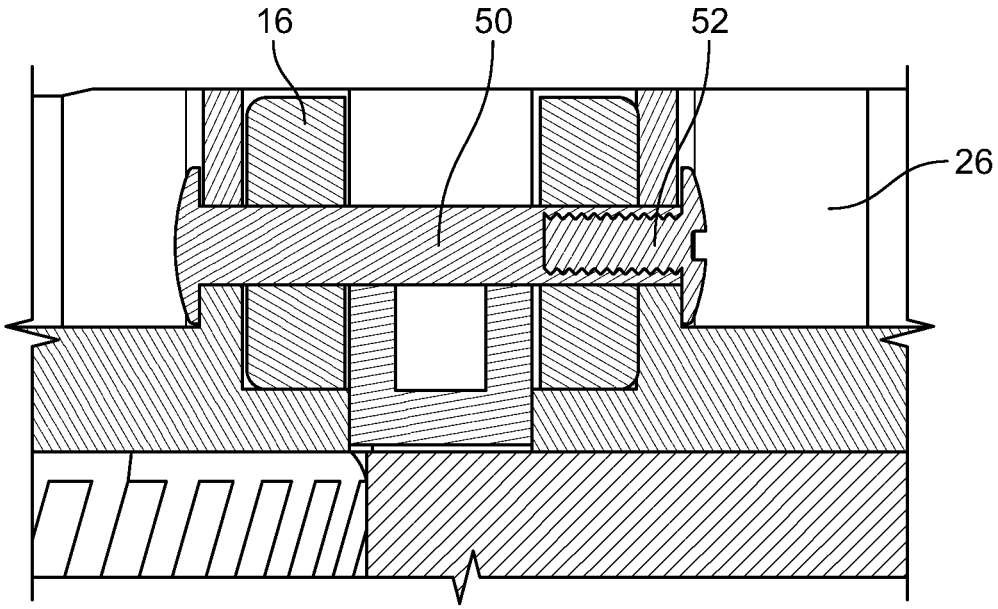

Referring now to FIGS. 4A-4G, in some embodiments, the disc launcher 10 may be moved from a disc pick-up configuration to a disc launching configuration, by adjusting an angle of the handle 12 relative to the disc holder 20. The purpose of this adjustability is to allow a user to pick up a disc 30 off the ground without having to stoop or bend over and pick up the disc 30 by hand. FIG. 4A is a detailed perspective view of the attachment end 16 of the handle 12 and a small portion of the top support member 26 of the disc holder 20. FIG. 4B is a close-up, cross-sectional view of a portion of FIG. 4A. These two figures illustrate that the attachment end 16 may be attached to the top support member 26 via an axle 50, which may include a screw 52, for example. The axle 50 may extend through a portion of the top support member 20 and two distal-most prongs or ends of the attachment end 16, such that the attachment end can rotate about the axle 50 to move up and down relative to the top support member 26. The top support member 26 may also include a locking member 54 (or "snap lock"), which locks the attachment end 16 in a parallel configuration relative to the top support member 26. This parallel configuration is also called the throwing configuration, since this is the position used for throwing or launching the disc 30 from the disc launcher 10. Any non-parallel configuration or position, where the handle 12 is angled relative to the top support member 26, may be referred to as a disc pick-up or disc loading configuration.

Figure 4C:
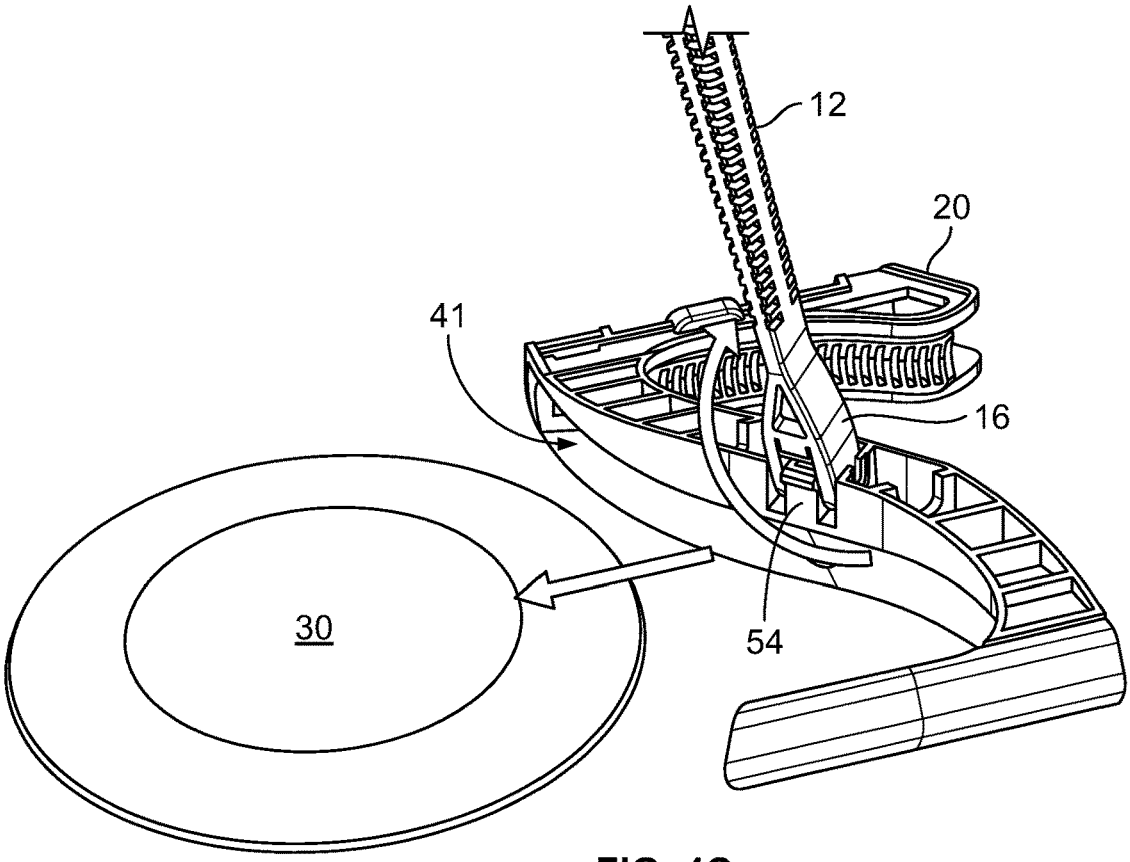
FIG. 4C is a perspective view of the portion of the disc launching device of FIGS. 4A and 4B, illustrating a loading configuration and loading motion for a disc, according to one embodiment.
Figure 4D:
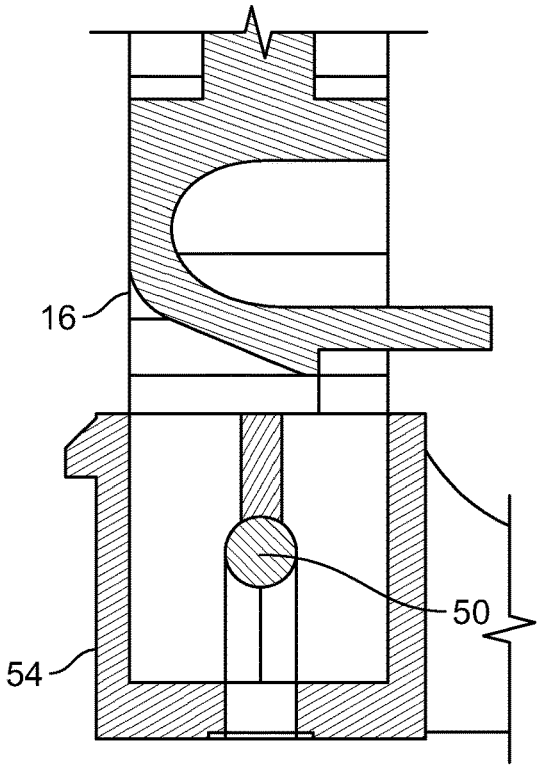
FIG. 4D is a side cross-sectional view of a portion of FIG. 4C, showing the connection between the handle and the top support member in the loading configuration.

FIGS. 4C and 4D illustrate this disc loading configuration. The curved arrow illustrates how the handle 12 swings up, relative to the disc holder 20, to assume the disc pick-up configuration. In some embodiments, the handle 12 may be positioned at a 90-degree angle relative to the disc holder 20 when in the disc loading configuration. Alternatively, the angle may be less than 90 degrees for disc loading in some embodiments. The user may then slide the back opening 41 of the disc holder 20 over the disc 30, to load the disc 30 into the disc holder 20. In some embodiments, the locking member 54 or a different locking member may act to lock the handle 12 in the disc pick-up configuration.

Figure 4E:
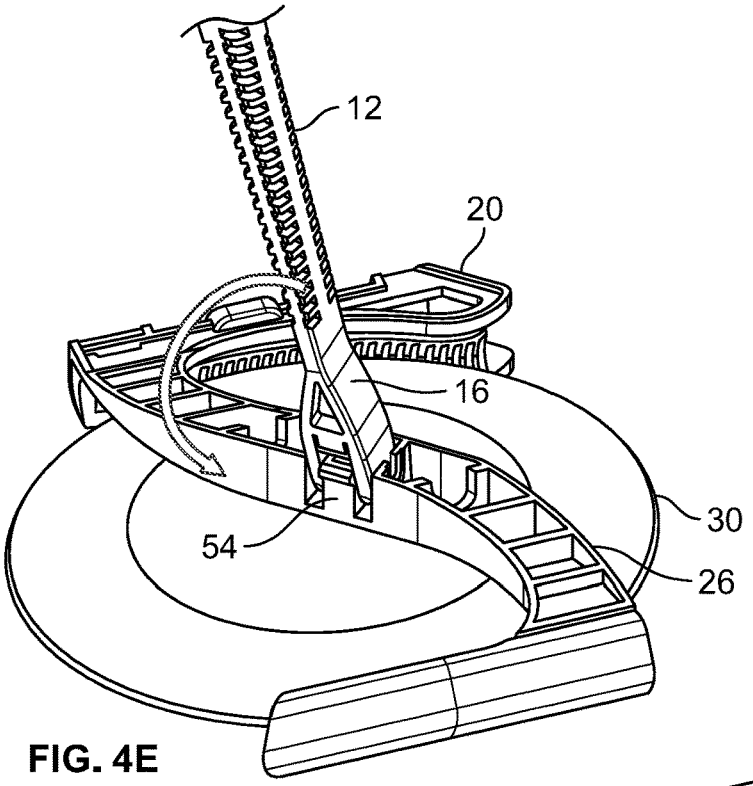
FIG. 4E is a perspective view of the portion of the disc launching device of FIG. 4C, illustrating a motion for returning the disc launching device to a throwing configuration.
Figure 4F:
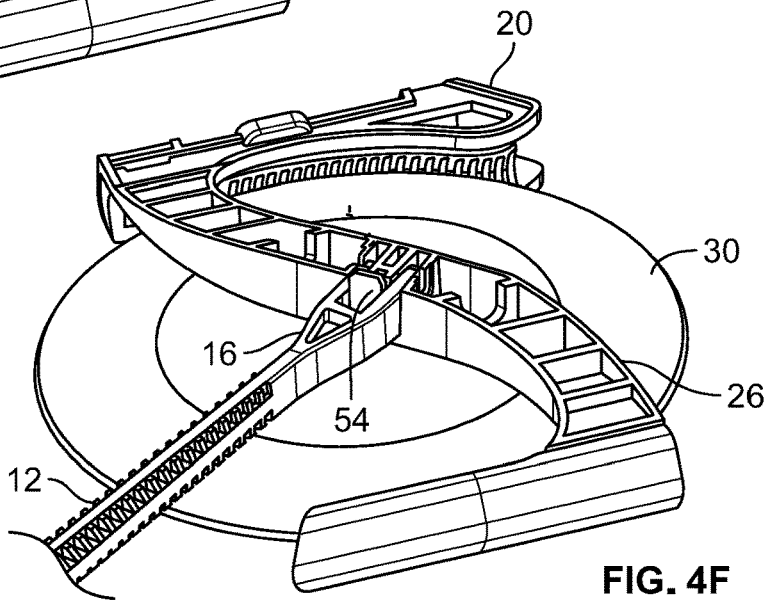
FIG. 4F is a perspective view of the same portion as in FIG. 4E, but shown in a throwing configuration, as opposed to the loading configuration.
Figure 4G:
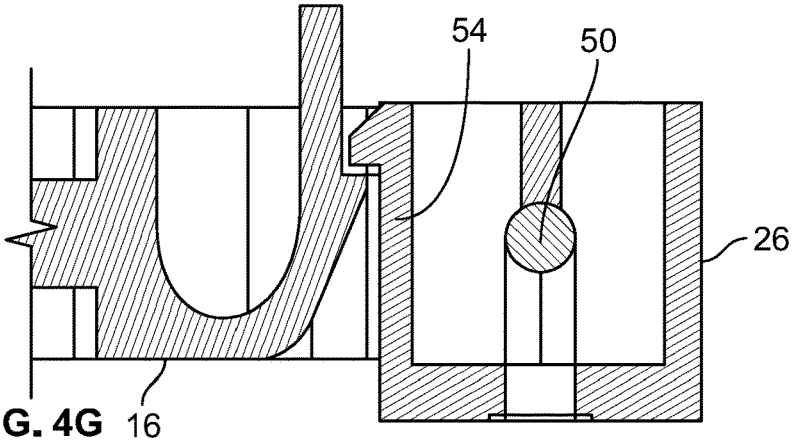
FIG. 4G is a side cross-sectional view of a portion of FIG. 4F, showing the connection between the handle and the top support member in the throwing configuration.

FIGS. 4E-4G illustrate how the handle 12 is moved from the disc loading configuration (FIG. 4E) to the throwing configuration (FIG. 4F). FIG. 4G is a detailed, cross-sectional view, illustrating how the locking member 54 locks the attachment end 16 of the handle 12 relative to the top support member 26 of the disc holder 20 in the throwing configuration.

With reference now to FIGS. 5A-5F, the disc holding and deflection features of the disc launching device 10 will be explained in further detail. As previously described, the disc 30 is held in the disc holder 20 by the front rail 22 and the back rail 24, which are connected by the top support member 26 and the bottom support member 32. In some embodiments, the top support member 26 and the bottom support member 32 may also help to hold the disc 30. The top support member 26 and the bottom support member 32 may help prevent the disc 30 from bowing or bending up or down during the throwing process, thus improving gyroscopic stability. The focus of the disc holding forces, and thus the following description, is on the front rail 22 and the back rail 24.

In general, the back rail 24 is either completely straight or almost completely straight. It is a low friction holder of the disc 30, meaning that, compared to the front rail 22, it allows the disc 30 to exit the front opening 40 with little friction or resistance. The front rail 22, by contrast, is at least slightly curved and may also be longer than the back rail 24. The front rail thus curves around the disc 30, making the front opening 40 smaller than the diameter of the disc 30. This curvature not only holds the disc 30 in the disc holder 20 but also provides resistance against the disc 30, creating elastic potential energy, which is converted to angular momentum and spin of the disc 30 as it exits the front opening 40. This resistance or friction converts angular momentum (of the swinging handle 12) into spin of the disc 30. For the disc 30 to exit the front opening 40, however, one or more portions of the front rail 22 and in some cases the back rail 24 must deflect.

Figure 5A:
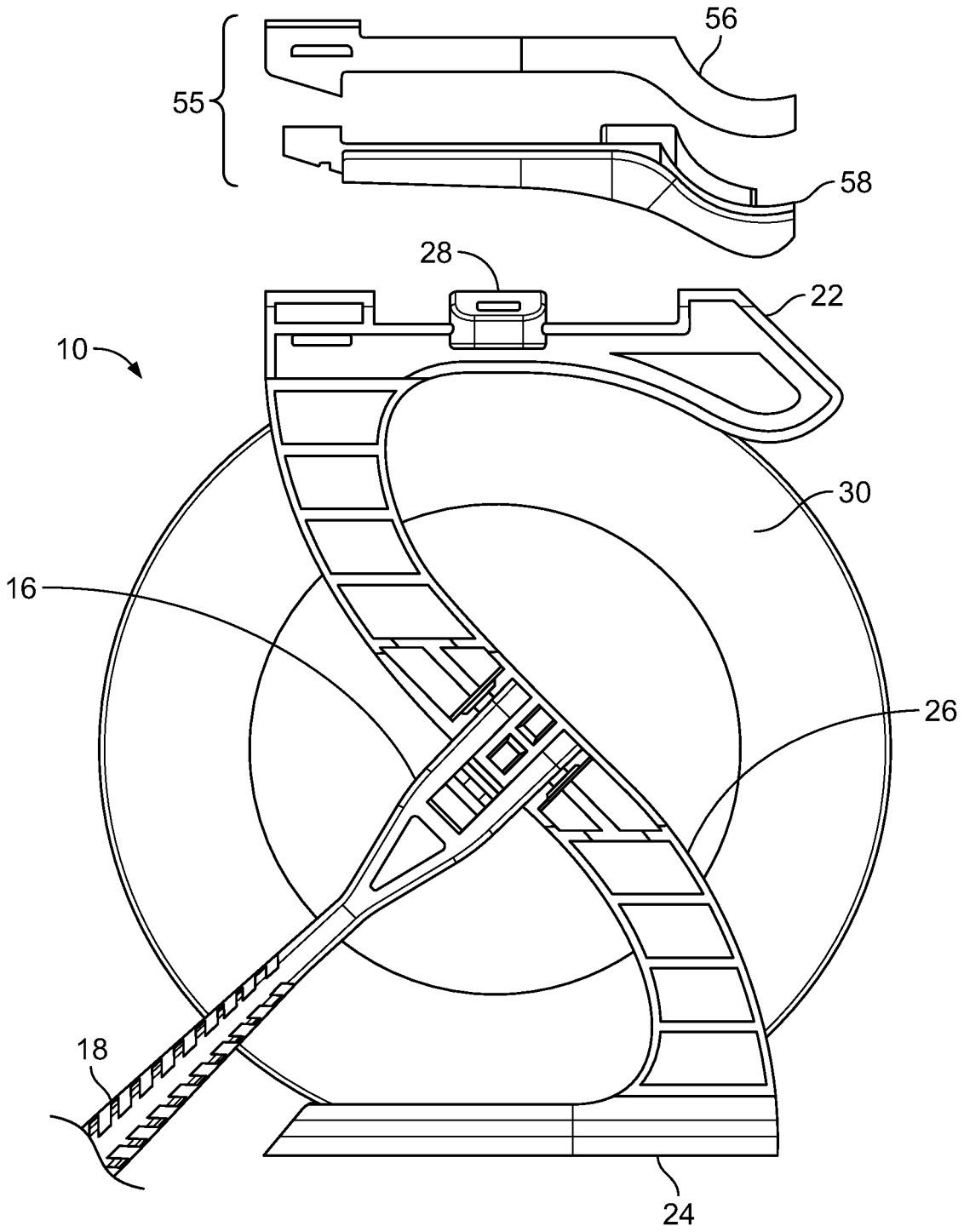
FIG. 5A is a top, partially exploded view of the disc holder and distal portion of the handle of the disc launching device, illustrating connection of a deflection member to the front rail of the disc holder, according to one embodiment.

Referring to FIG. 5A, in one embodiment two pieces may be attached to the front rail 22 to provide a deflection member 55, for applying a holding force to the disc 30. The deflection member 55 fits down into the front rail, between the top portion and the bottom portion of the rail 22. The top piece of the deflection member 55 may be referred to as a flexible beam 56, and the bottom piece may be referred to as disc contact member 58. In alternative embodiments, the deflection member 55 may be one piece or may be integral with the front rail 22. Although this fact will not be repeated below, any of the features described below as applying to the flexible beam 56 or the disc contact member 58 may be applied, in alternative embodiments, to a combined, one-piece deflection member 55 or a deflection portion that is integral with the front rail 22.

Figure 5B:
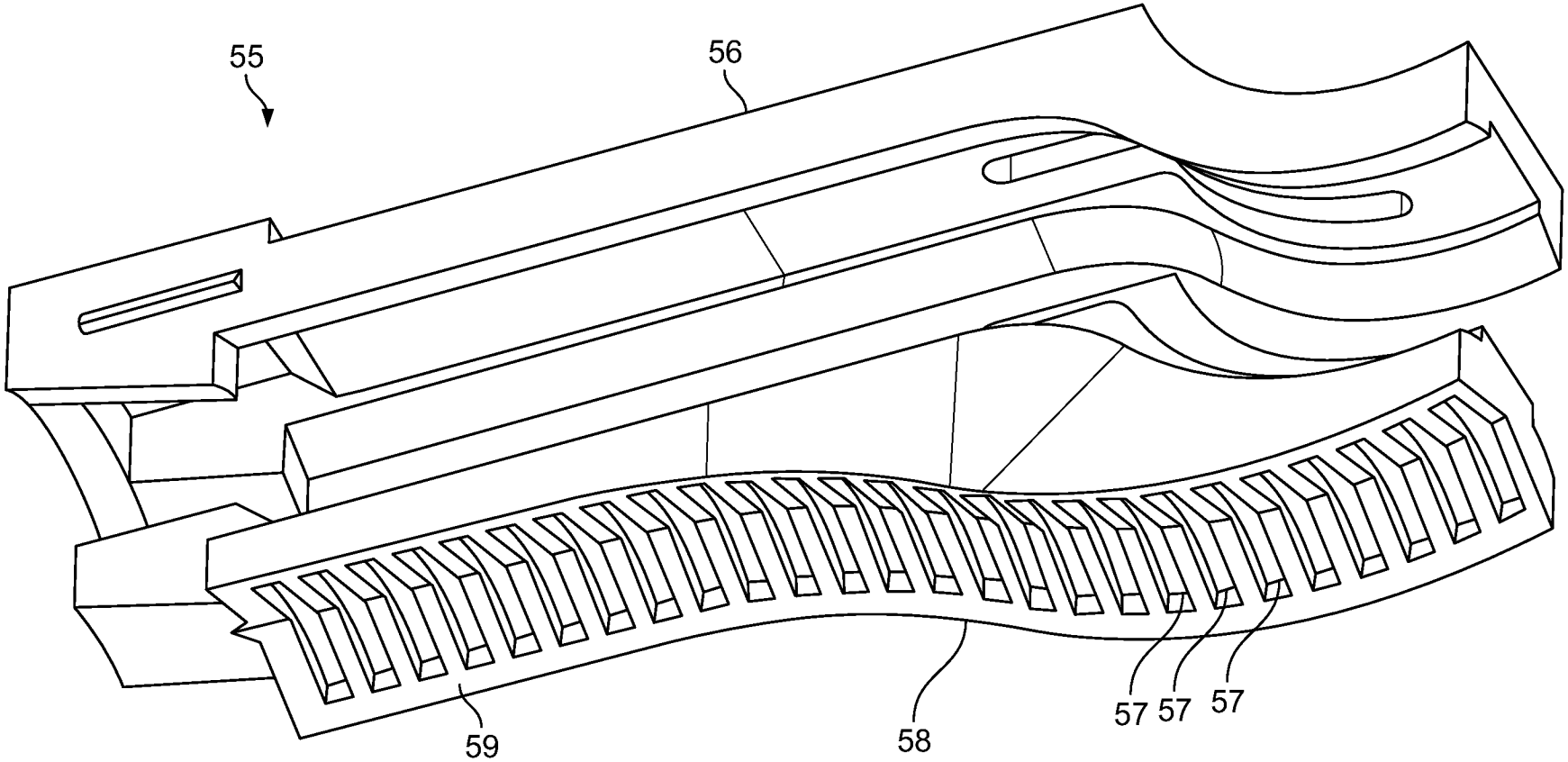
FIG. 5B is a bottom perspective view of the two-part deflection member of FIG. 5A.

FIG. 5B shows the deflection member 55 in greater detail. This figure shows how, in this embodiment, the disc contact member 58 fits within the flexible beam. It also illustrates the V-shaped inner surface 59 and multiple grooves 57 of the disc contact member 58. The inner surface 59 of the disc contact member 58 may have any suitable shape, surface texture, material or other features to enhance its function. In one embodiment, the flexible beam 56 may be made out of a relatively hard plastic material, and the disc contact member 58 may be made of a more flexible, low durometer material, such as rubber, so that it grips the edge of the disc 30. Additionally, in some embodiments, the disc launching device 10 may be provided with multiple disc contact members 58, each having a different height or thickness from top to bottom. These different disc contact members 58 may be interchanged to make the disc launcher 10 compatible with multiple different sizes of discs.

Figure 5C:
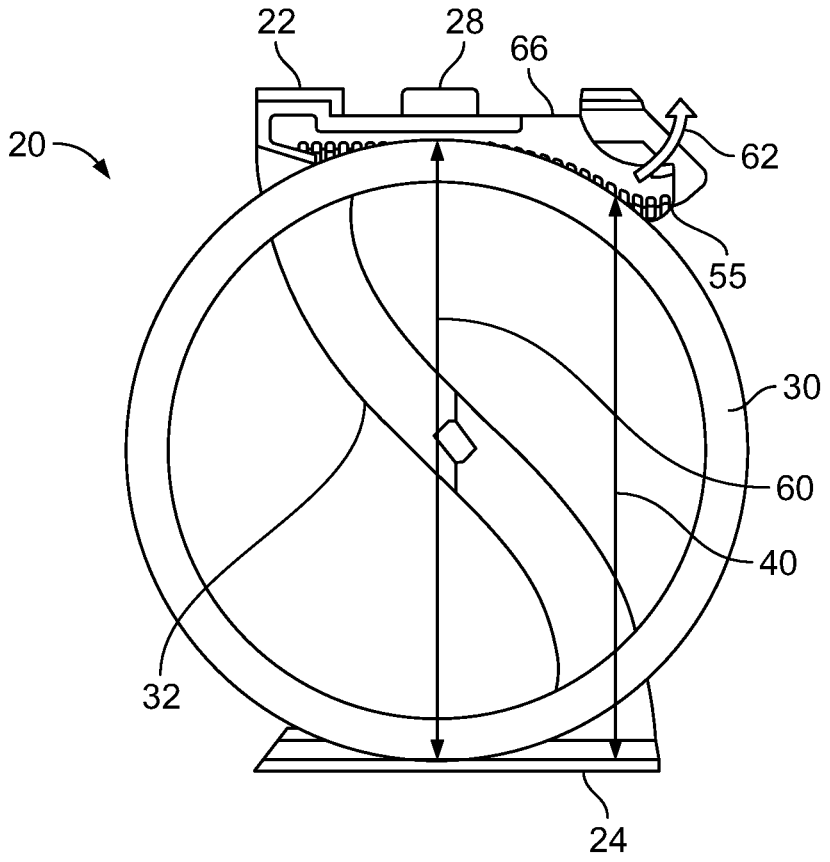
FIG. 5C is a top, partial cross-sectional view of the disc holder of the disc launching device, illustrating the size of the front opening, compared to the diameter of the disc, according to one embodiment.

FIG. 5C is a top view of the disc holder 20, with the center of the disc 30 and portions of the disc holder 20 removed for illustrative purposes. FIG. 5C illustrates that the diameter 60 of the disc is larger than that of the front opening 40. The deflection member 55 must thus deflect upward (or outward) in the deflection direction 62, to allow the disc 30 to launch through the front opening 40. A portion of the deflection member 55 located in front of the adjustment slider 28 may be referred to as the deflection portion 66. The longer the deflection portion 66, the more flexible and easily deflected will be the front rail 22. The shorter the deflection portion 66, the stiffer and more resistant to deflection will be the front rail 22.

Figure 5D:
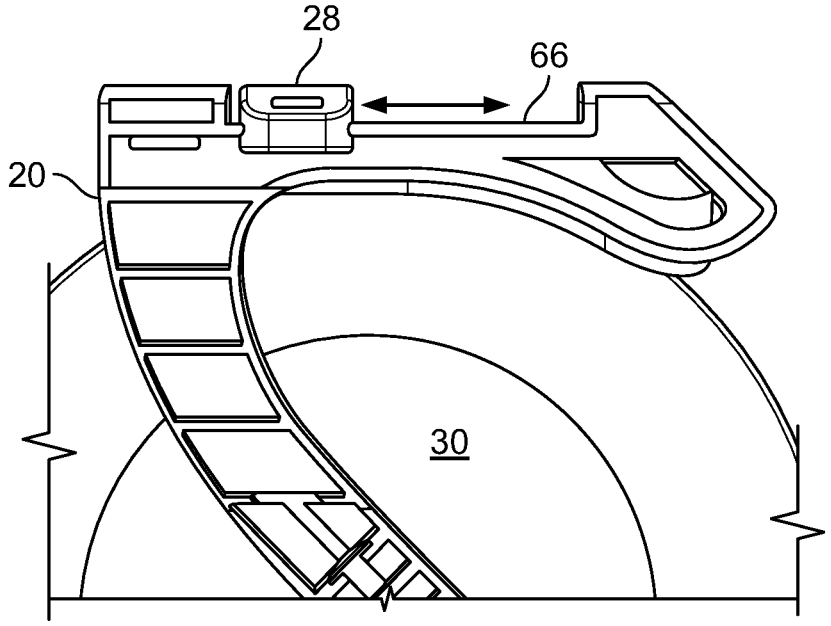
FIGS. 5D-5F are top views of the front rail of the disc holder, illustrating motion of an adjustment slider to adjust spin, forces and launch speed applied to the disc by the disc launching device, according to one embodiment.
Figure 5E:
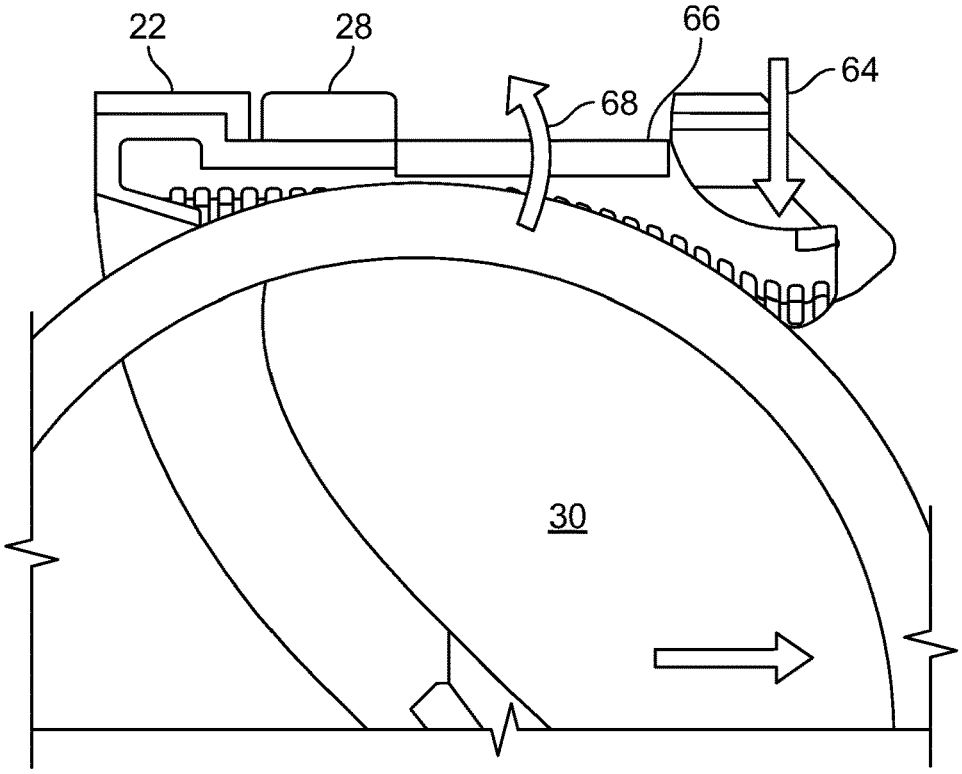
Figure 5F:
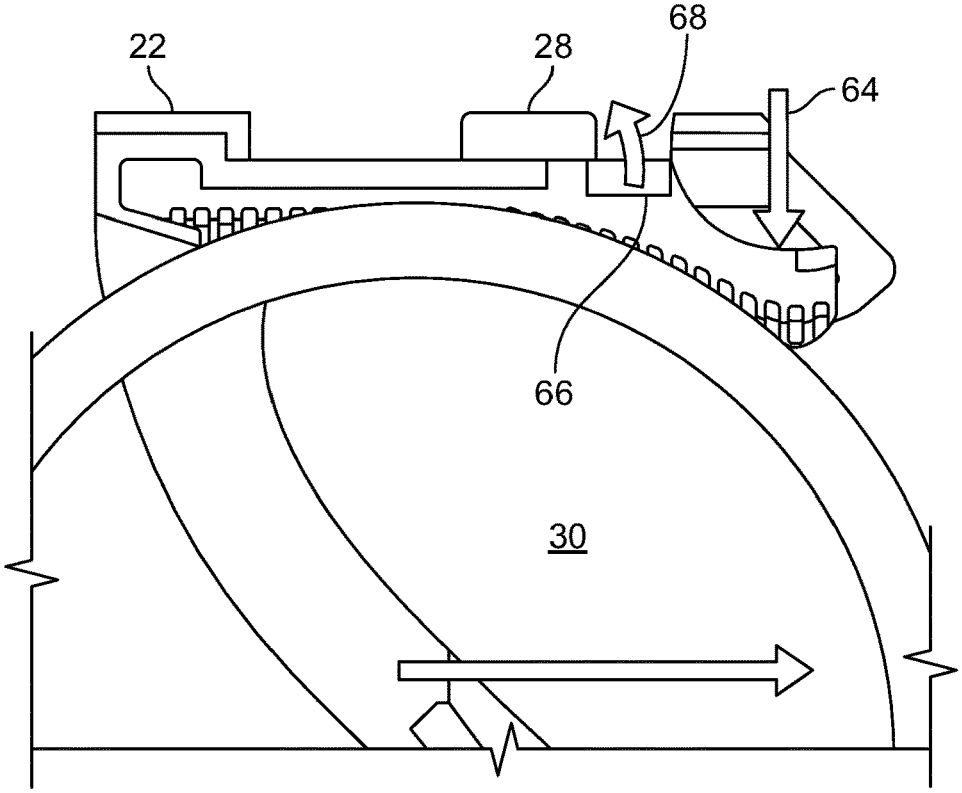

As illustrated in FIGS. 5D-5F, sliding the adjustment slider 28 along the front rail 22 adjusts the stiffness/flexibility of the deflection member 55 and thus the front rail 22. FIGS. 5D and 5E show the adjustment slider 28 in a far rear position, which makes the front rail 22 and the deflection member 55 the most flexible/most easily deflected. The straight, downward pointing arrow illustrates the vertical holding force 64 applied to the disc 30 by the deflection member 55 and the front rail 22. The curved arrow shows the deflection force direction 68 that the disc places on the deflection portion 68 as disc launching force is applied by swinging the handle 12. A disc throw with the disc holder 20 in this configuration will typically be slower in speed and shorter in distance.

Referring to FIG. 5F, sliding the adjustment slider 28 along the top rail 22 towards the front opening 40 makes the front rail 22 stiffer, thus increasing the required launching force and the spin on the disc 30. Sliding the adjustment slider 28 away from the front opening 40 makes the front rail 22 more flexible, thus decreasing the required launching force and the spin on the disc 30. In this configuration, more holding force is placed on the disc 30 by the front rail 22, and it is harder to deflect the deflection portion 66. A disc throw with the disc holder 20 in this configuration will typically be faster in speed and longer in distance. This method of adjusting the adjustment slider 28 forwards and/or backwards may be referred to as the "dial-a-distance" method.

Figure 6A:
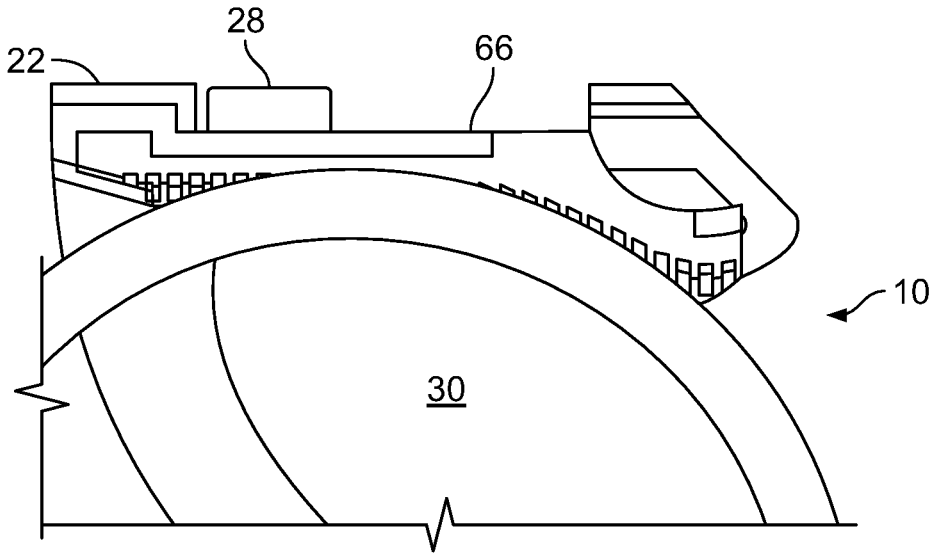
FIG. 6A is a top view of the front rail of the disc holder, illustrating a setting of the adjustment slider at a lowest deflection force or "slow throw" position, according to one embodiment.
Figure 6B:
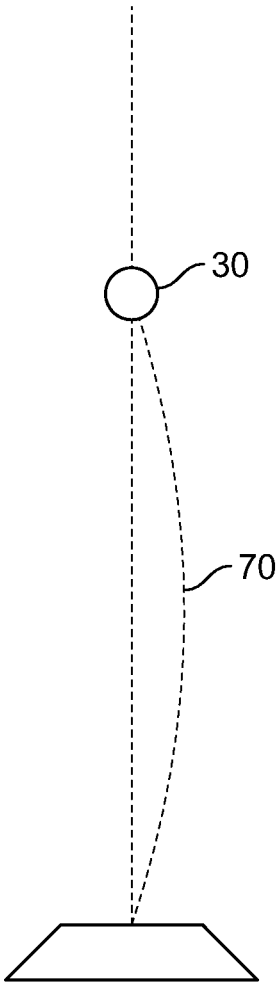
FIG. 6B illustrates an example trajectory of a disc thrown with a slow throw when the adjustment slider is in the slow throw position, as in FIG. 6A.
Figure 6C:
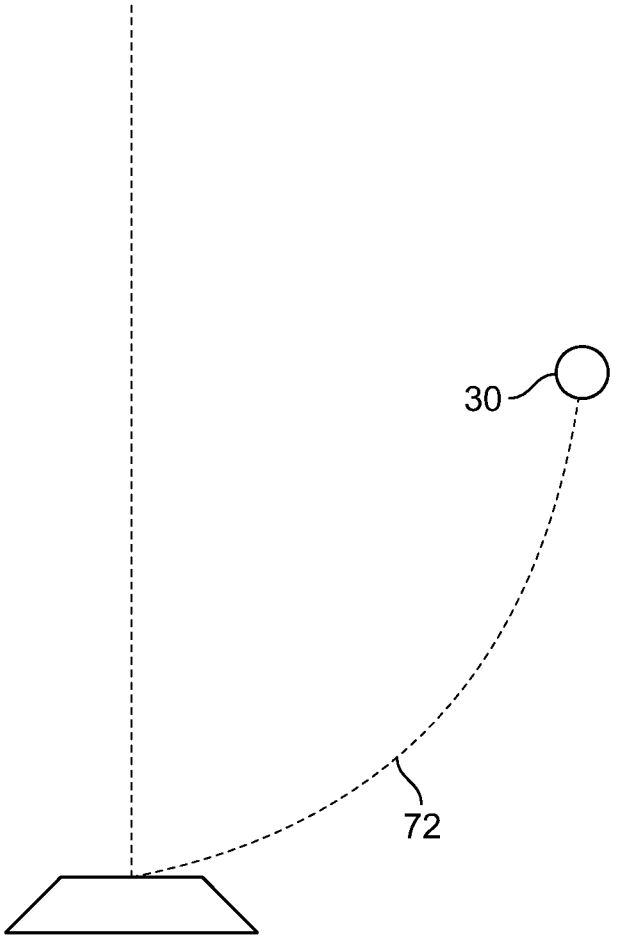
FIG. 6C illustrates an example trajectory of a disc thrown with a fast throw when the adjustment slider is in the slow throw position, as in FIG. 6A.

With reference now to FIGS. 6A-6C, two examples are illustrated of disc throws from the disc launching device 10. As illustrated in FIG. 6A, for these two example disc throws, the adjustment slider 28 is positioned at the back end of the front rail 22, thus creating a large deflection portion 66. This is the most flexible, least resistant position and may be referred to as the "slow throw position." FIG. 6B illustrates a slow, easy, low force throw made with the disc launcher 10 in the slow throw position. As illustrated, the throw results in a relatively straight trajectory 70, and although not apparent from a drawing, the disc 30 will travel at a slower speed. The disc 30 may travel, for example, approximately 200 feet with such a throw.

FIG. 6C illustrates what might happen if the user attempts a fast, high force throw with the disc launcher 10 in the configuration of FIG. 6A. In this example, the disc 30, which is subjected to a larger, harder swinging force, exits the disc holder 20 earlier in the swing and launches out in a sideways trajectory 72. The speed of the disc 30 will be faster, but it does not travel straight and might only travel, for example, approximately 150 feet.

Figure 7A:
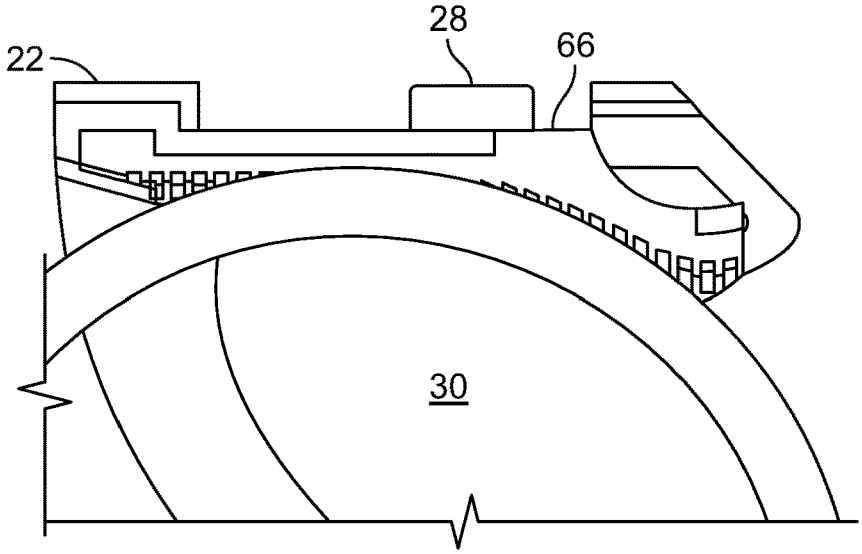
FIG. 7A is a top view of the front rail of the disc holder, illustrating a setting of the adjustment slider at or near a highest deflection force or "fast throw" position, according to one embodiment.
Figure 7B:
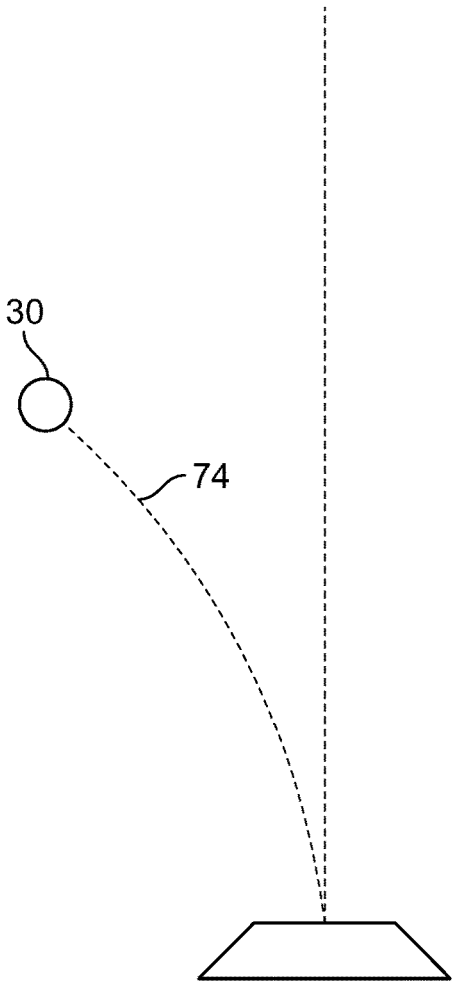
FIG. 7B illustrates an example trajectory of a disc thrown with a slow throw when the adjustment slider is in the fast throw position, as in FIG. 7A.
Figure 7C:
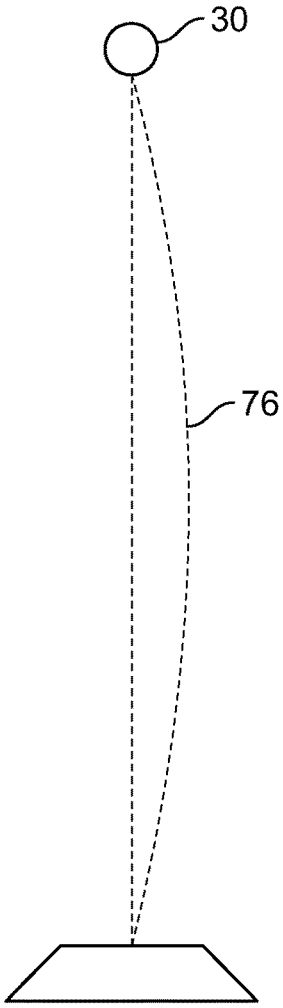
FIG. 7C illustrates an example trajectory of a disc thrown with a fast throw when the adjustment slider is in the fast throw position, as in FIG. 7A.

FIGS. 7A-7C show the opposite throwing scenario, with the disc holder in the "fast throw position," with the adjustment slider moved almost all the way forward, thus creating a very short deflection portion 66 (FIG. 7A). In FIG. 7B, the disc 30 has been subjected to a slower, easier swinging force and exits the disc holder 20 later in the swing and launches out in a sideways trajectory 74. The speed is slow, the trajectory is not straight, and the distance will be short, such as about 150 feet for example. In FIG. 7C, the disc 30 has been subjected to a faster, harder swing of the disc launcher 10, thus sending the disc 30 on a straighter, farther path, for example about 400 feet. Of course, a nearly infinite number of adjustment positions of adjustment slider 28 and velocity of throws may be applied to the disc launcher 10, resulting in a nearly infinite number of different throw paths and distances. FIGS. 6A-7C are provided for exemplary purposes only.

Figure 8A:
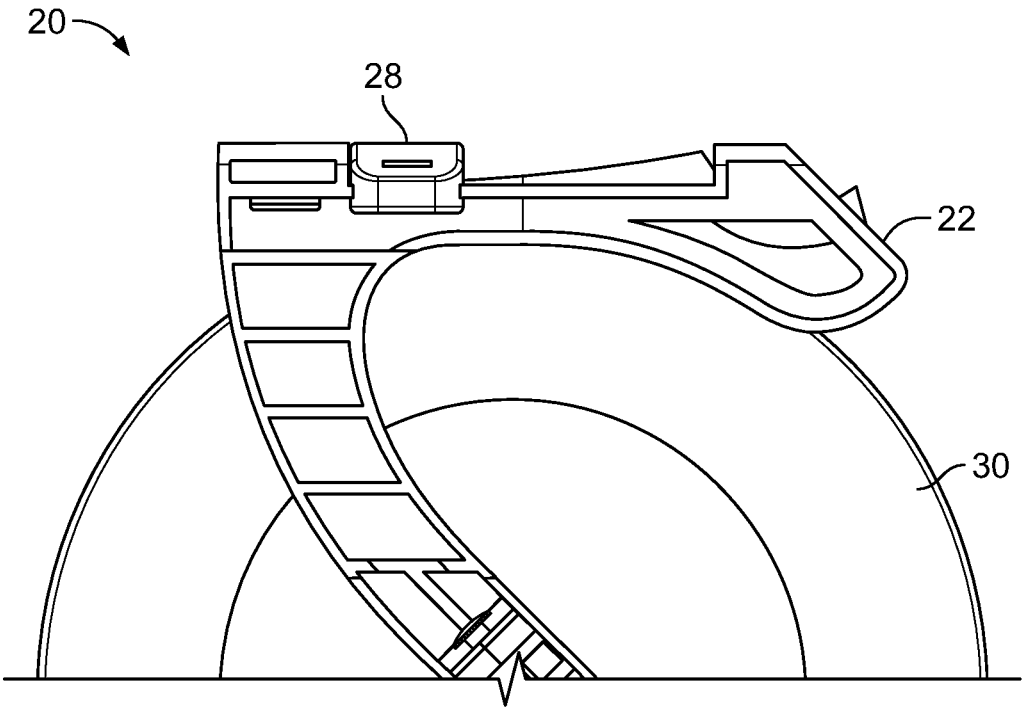
FIGS. 8A and 8B are top and cross-sectional views, respectively (portions of the disc holder removed for illustrative purposes in FIG. 8B), showing the front rail of the disc holder, with the adjustment slider in the slow throw position.
Figure 8B:
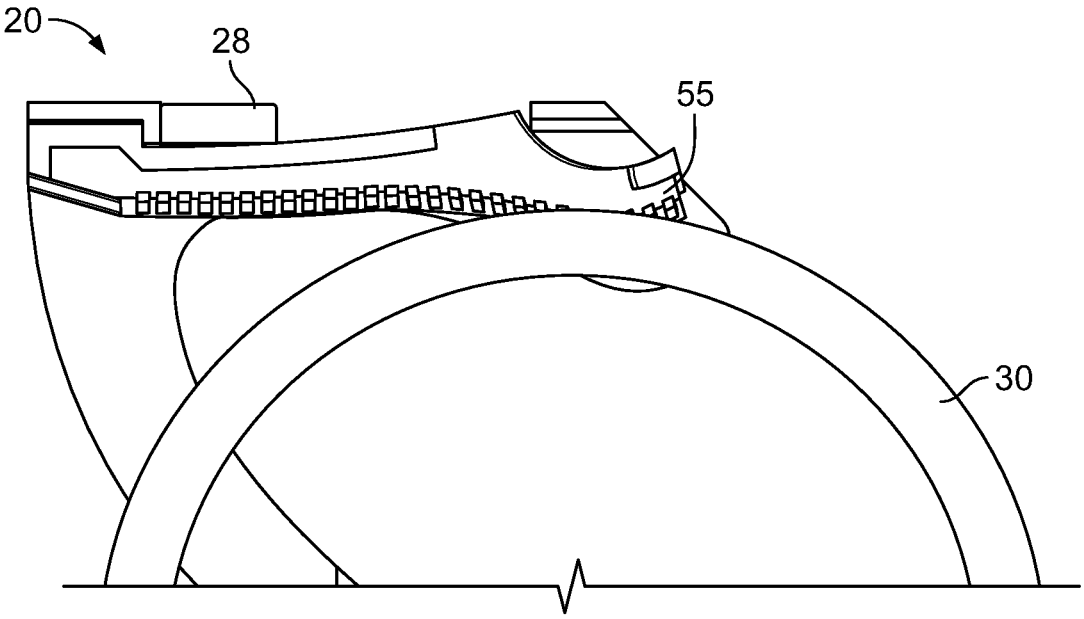
Figure 8C:
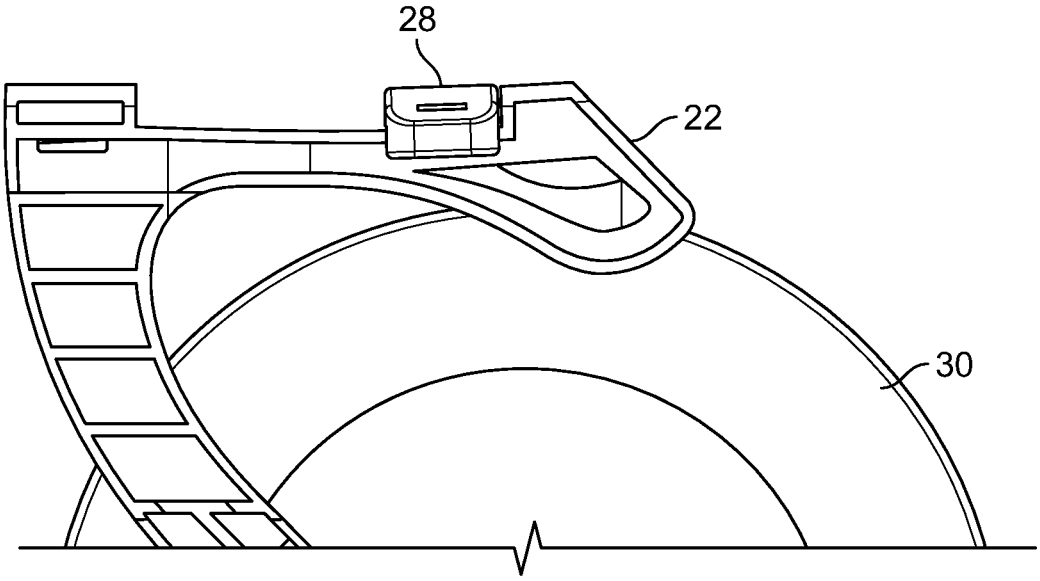
FIGS. 8C and 8D are top and cross-sectional views, respectively (portions of the disc holder removed for illustrative purposes in FIG. 8D), showing the front rail of the disc holder, with the adjustment slider in the fast throw position.
Figure 8D:
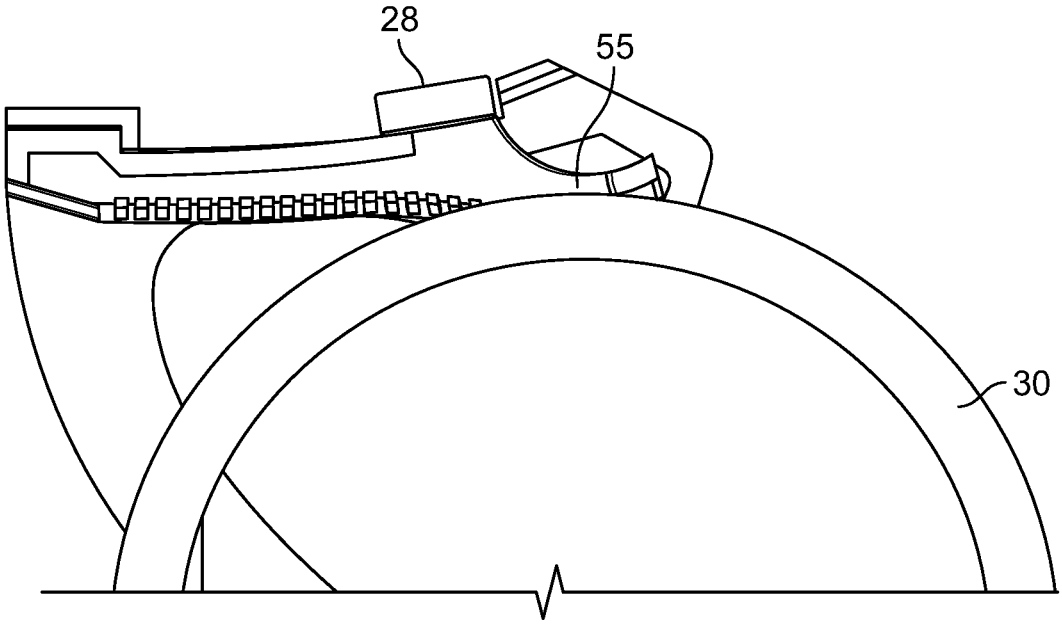
Figure 8E:
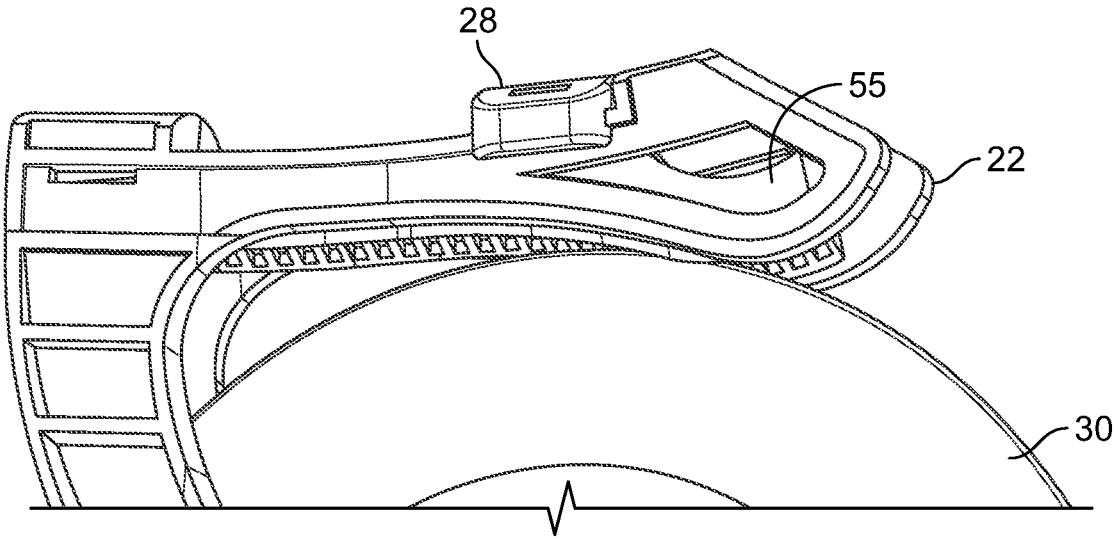
FIGS. 8E and 8F are perspective views showing the front rail of the disc holder and deflection of the deflection member, with the adjustment slider in the fast throw position (FIG. 8E) and in the slow throw position (FIG. 8F)
Figure 8F:
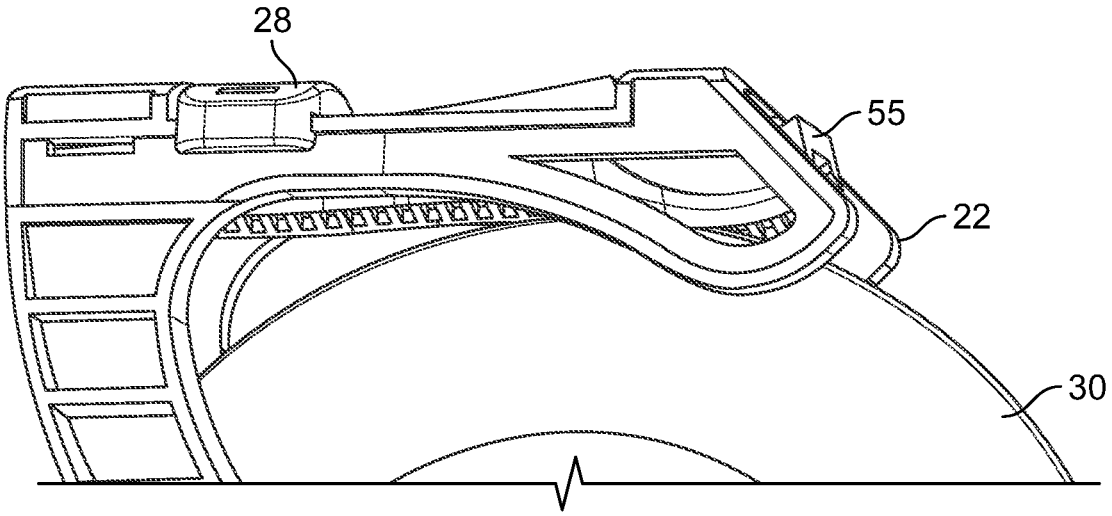

FIGS. 8A-8F are various views of the top rail 22 and the deflection member 55 of the disc holder 20, shown in relation to the disc 30. These figures illustrate how the top rail 22 and the deflection member 55 deflect differently when the adjustment slider 28 is the rearward or "slow throw"

position (FIGS. 8A, 8B, 8F) versus the forward or "fast throw" position (FIGS. 8C-8E).

FIGS. 9A-11E illustrate an alternative embodiment of a disc launching device 100. The primary difference between this embodiment and the previously described disc launcher 10 is that this disc launcher 100 has only a top support member 126 and no bottom support member. This will be described in further detail below. In general, any of the features, attributes and methods of use described above may be included in, or applied to, the disc launcher 100 of FIGS. 9A-11E.

Figure 9A:
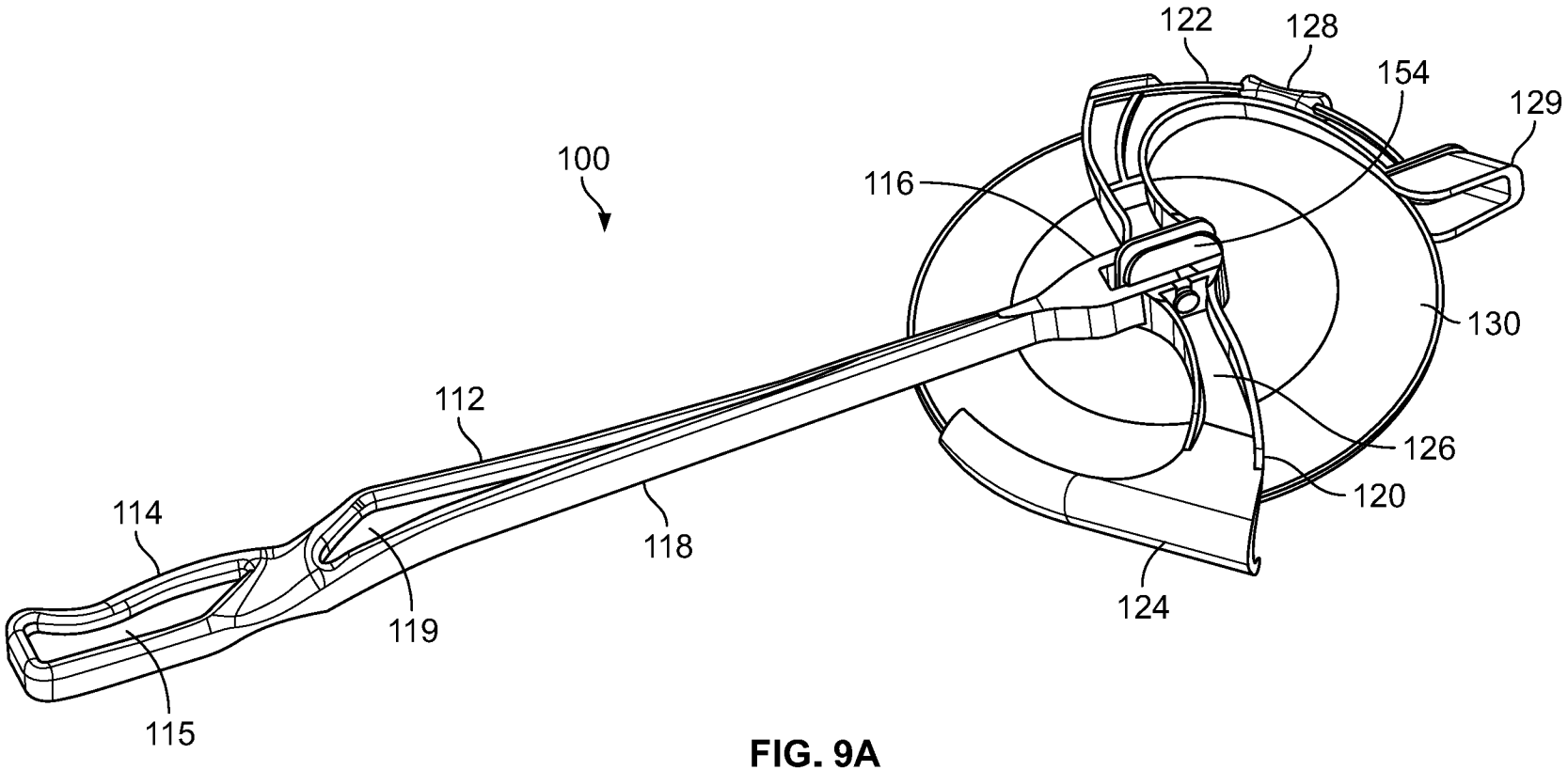
FIGS. 9A and 9B are top perspective and bottom perspective views, respectively, of a disc launching device, according to an alternative embodiment that includes a top support member but not a bottom support member.

Referring now to FIG. 9A, the disc launcher 100 includes a handle 112 and a disc holder 120. In this embodiment, the handle 112 is an elongate, one-piece construction having a grip end 114 for holding with a hand, an attachment end 116 for attaching to the disc holder 120, and a shaft 118 extending between the two ends 114, 116. The disc holder 120 includes a front rail 122, a back rail 124, and the top support member 126 extending between the two rails 122, 124. The disc holder 120 may also include an adjustment member 128, for adjusting an amount of holding force applied to the disc 130 by the front rail 122, and a front channel connector 129. The front channel connector 129 provides a rigid connection for the front rail 122 and stabilizes the disc 130 upon exit. It extends upward more prominently in this embodiment of the disc launcher 100, because the front channel connector 129 needs to be larger than the diameter of the disc 130 in this embodiment, so the disc 130 can exit. This is the case, because the front rail 122 is curved to match the diameter of the disc, rather than relatively straight in the previous embodiment.

In this embodiment, the grip end 114 of the handle 112 includes a grip opening 115, and the shaft 118 includes a shaft opening 119. These may facilitate gripping and flexing of the handle, respectively. The attachment end 116 is U-shaped for attaching to the top support member 126. A locking member 154 on the top support member 126 locks the attachment end 116 relative to the top support member 126 in the throwing configuration, as discussed above. The handle 112 may be made of any suitable material, and various embodiments may have different amounts of stiffness or rigidity. Suitable materials may include, but are not limited to, plastic, rubber, various polymers, carbon-fiber composites, wood, metal or combinations thereof. In some embodiments, the handle 112 is one piece, while in other embodiments it may be multiple pieces attached together.

Figure 9B:
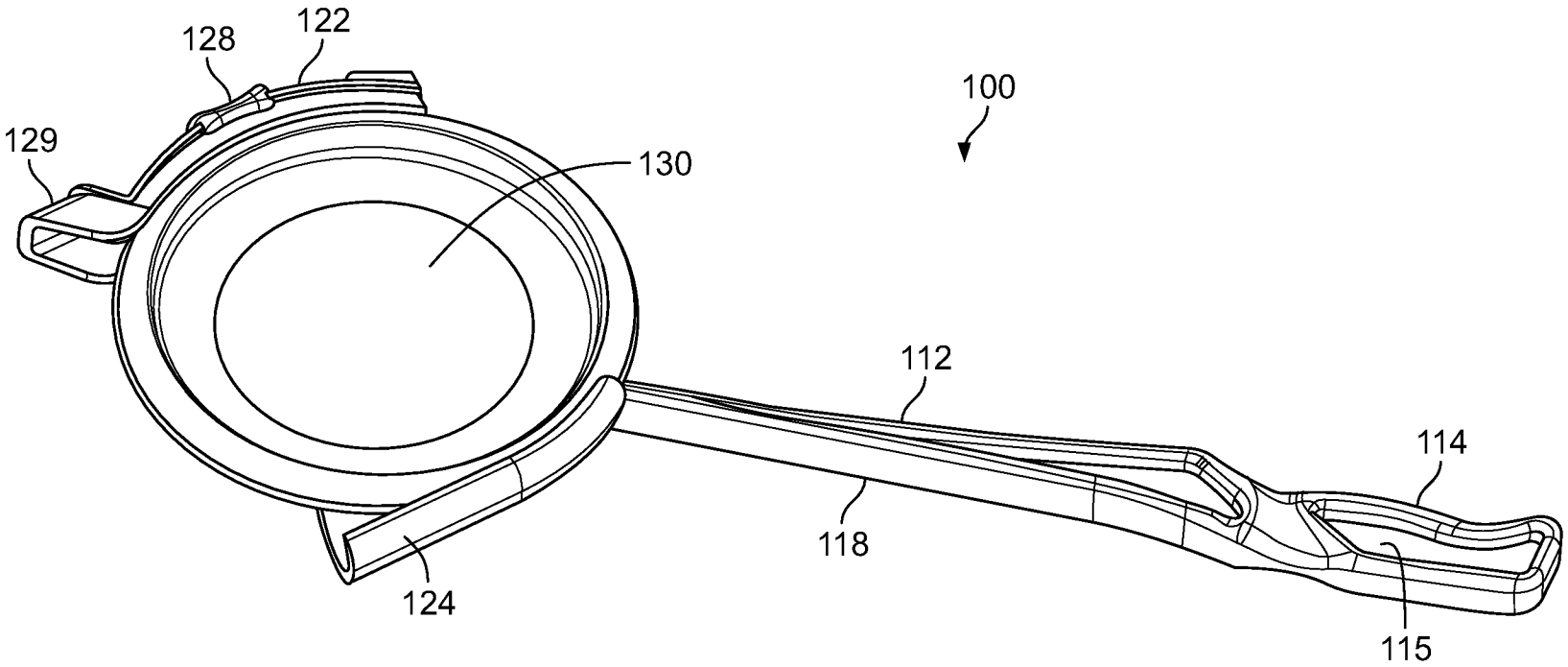

Referring now to FIG. 9B, a bottom view of the disc launching device 100 shows the lack of a bottom support member. Although there is no bottom support member, the front rail 122 and the back rail 124 have top and bottom portions, which contact and hold top and bottom surfaces of the disc 130. Thus, as will be shown in subsequent figures, the disc holder 120 contacts and applies holding force to the disc 130 in two different ways, as previously described.

Figure 9D:
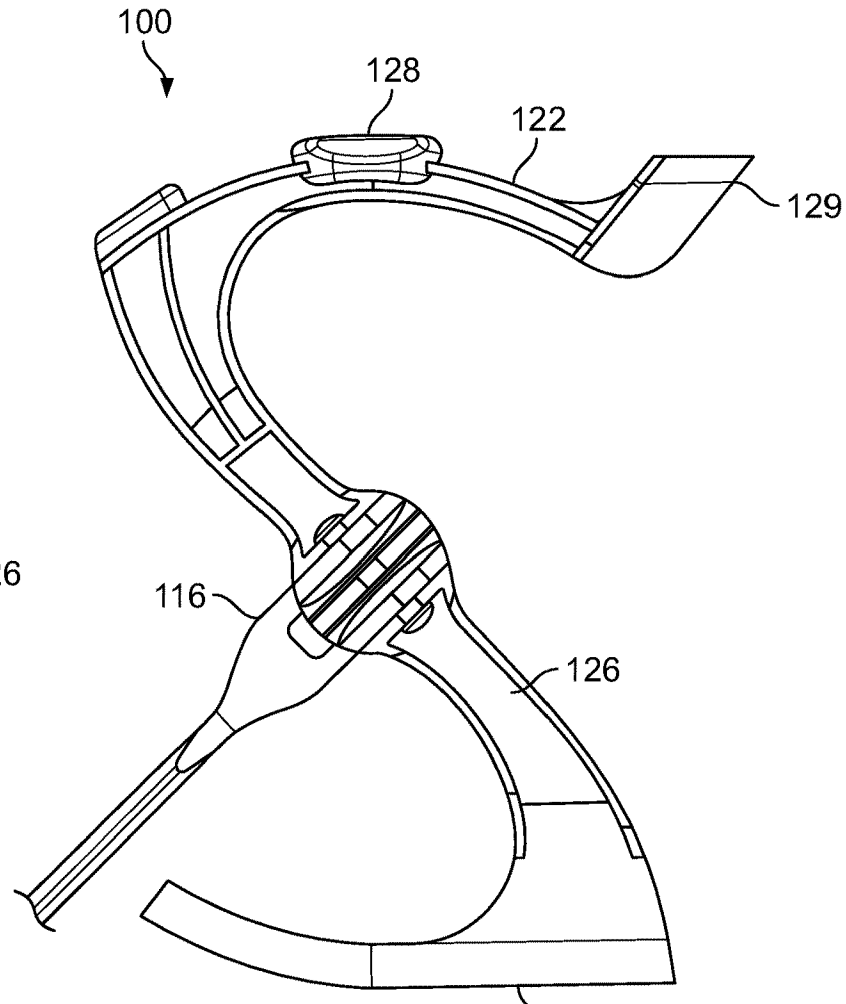
FIGS. 9C and 9D are top views of a disc holder and distal portion of a handle of the disc launching device of FIGS. 9A and 9B, with FIG. 9C including a disc.
Figure 9C:
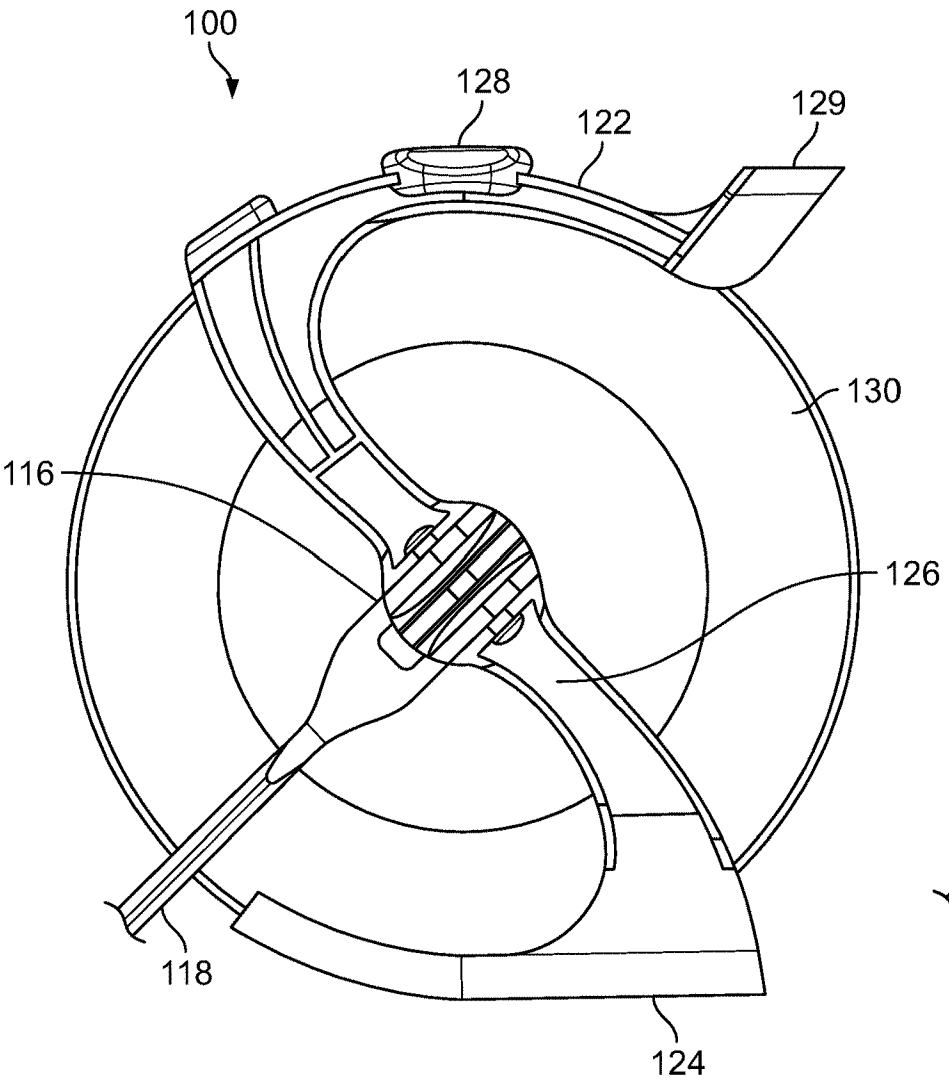

FIGS. 9C and 9D are top views of a portion of the disc launching device 100, including the disc holder 120 and the distal portion of the shaft 118 and the attachment portion 116 of the handle 112. FIG. 9C includes the disc 130, and FIG. 9D does not. As shown in these two figures, the disc holder 120 in this embodiment has a general S-shape, with both the front rail 122 and also the back rail 124 having a curved shape.

Figure 9E:
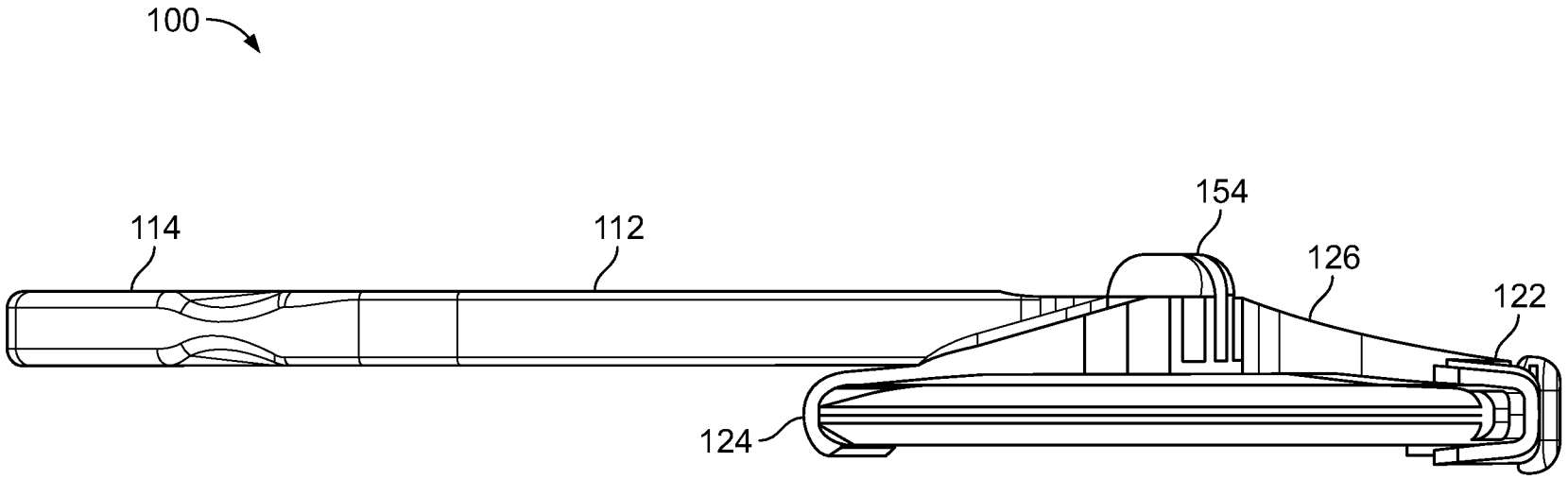
FIG. 9E is a front side view of the disc launching device of FIGS. 9A-9D, including a disc.

FIG. 9E is a front side view of the disc launcher 100. In this view, the locking member 154 is readily visible, protruding up from the top support member 126. The locking member locks the attachment end 116 of the handle 112 in the throwing configuration relative to the disc loader 120.

Figure 9F:
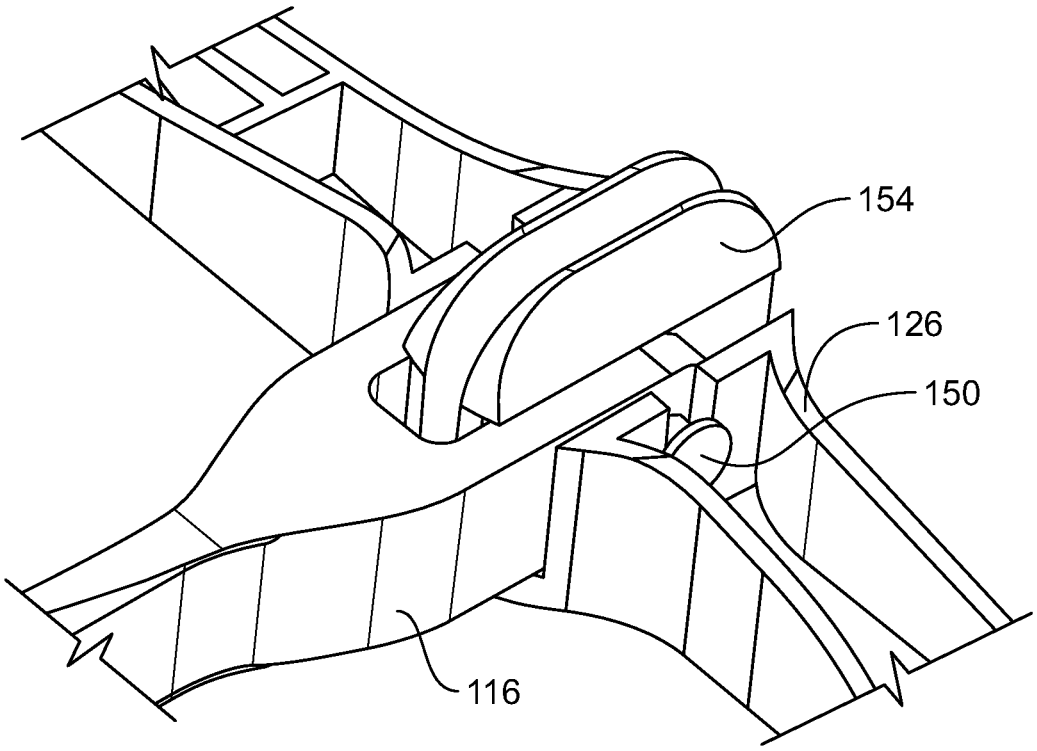
FIGS. 9F and 9G are top perspective and side cross-sectional views, respectively, of an attachment portion of a handle connected to a top support member of a disc launching device, according to one embodiment.
Figure 9G:
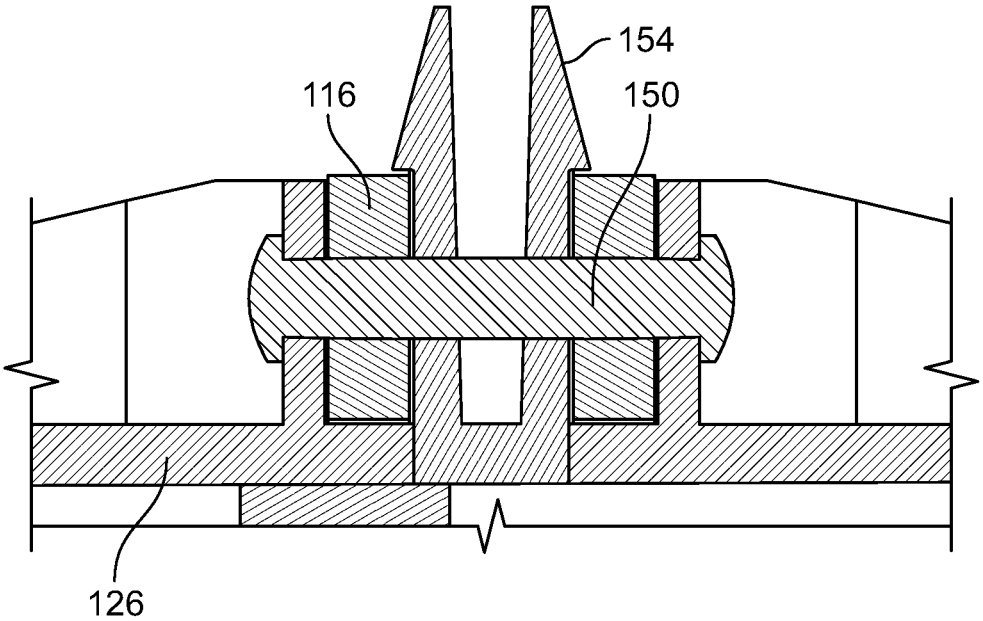

FIGS. 9F and 9G illustrate the attachment end 116 of the handle 112 and the locking member 154 of the top support member 126 in more detail. As with the previous embodiment, the locking member 154 may include an axle 150 or pivot member, and the attachment end 116 may lock in place by a snap-fit connection with the locking member 154.

Figure 9H:
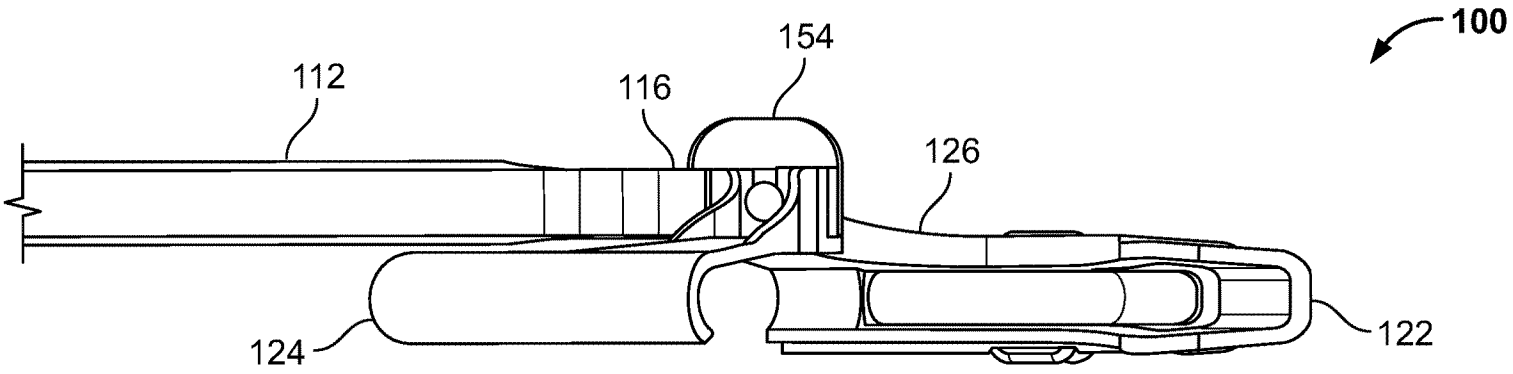
FIGS. 9H and 9I are side views of a distal portion of the handle and the top support member of the disc launching device, shown in throwing configuration (FIG. 9H) and loading configuration (FIG. 9I), according to one embodiment.
Figure 9I:
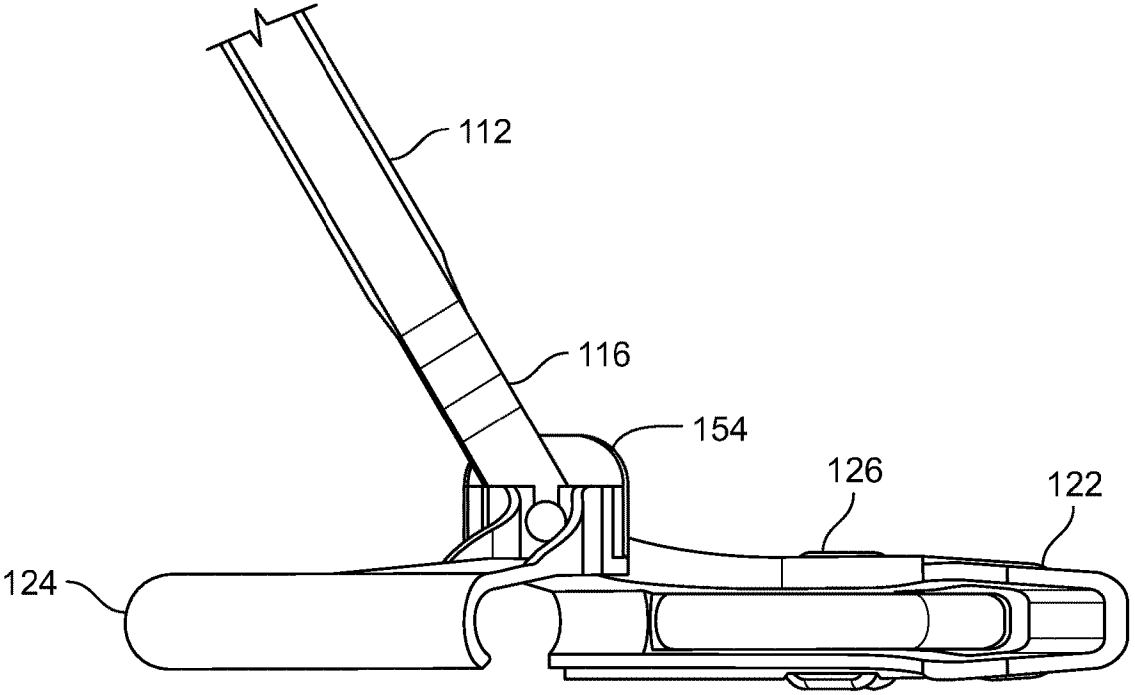

FIGS. 9H and 9I are side views of the distal portion of the handle 112 and the disc holder 120. FIG. 9H shows the handle 112 in the throwing configuration, wherein its longitudinal axis is parallel with the longitudinal axis of the disc holder 120. FIG. 9I shows the handle 112 in a disc loading configuration, wherein the handle 112 is angled upward relative to the disc holder 120.

Figure 10A:
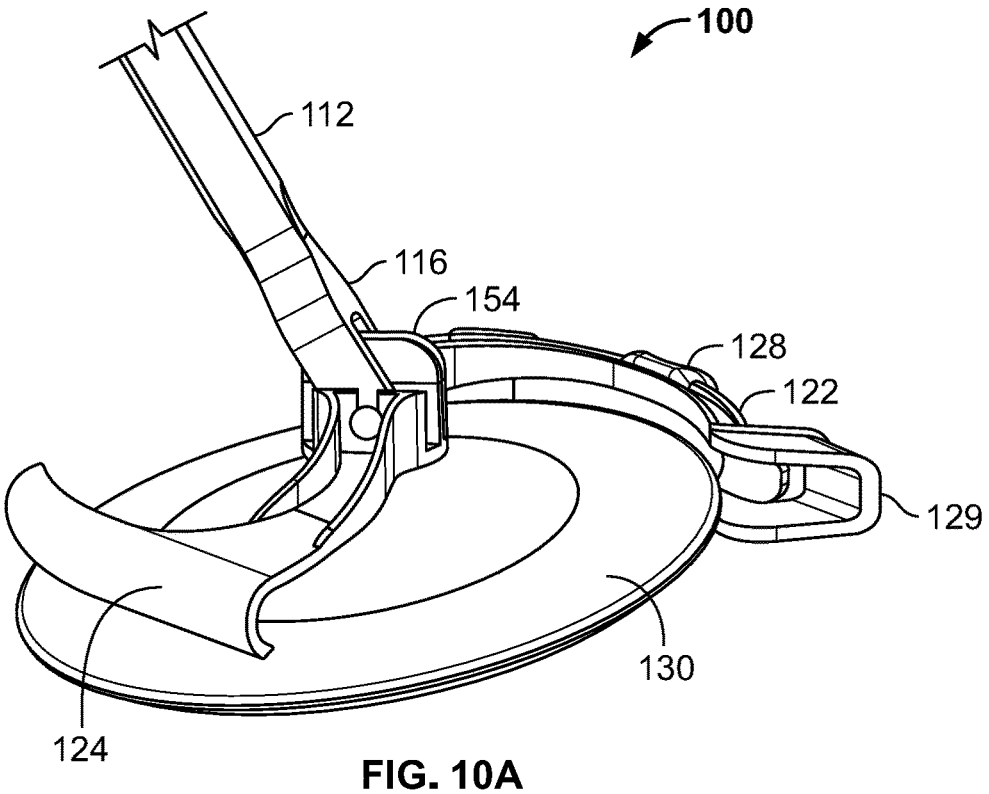
FIGS. 10A and 10B are perspective views of a distal portion of the disc launching device, illustrating a method for loading a disc into the device, according to one embodiment.
Figure 10B:
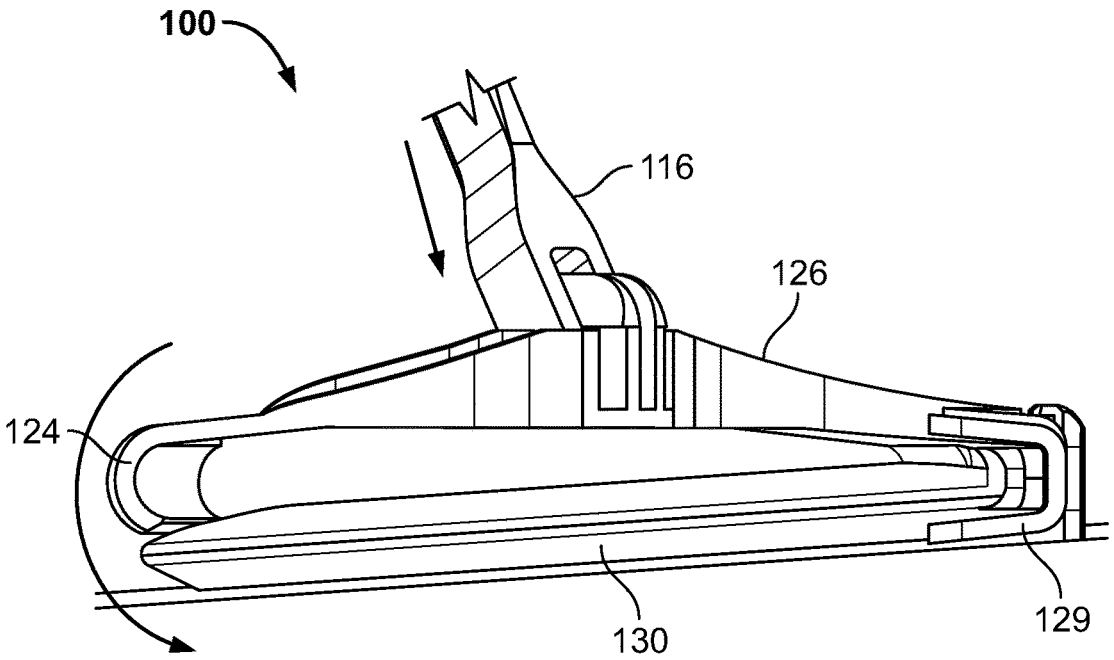

FIGS. 10A and 10B illustrate a method of picking up a disc 130 off the ground, using the disc launcher 100. Picking the disc 130 up off the ground with the launcher 100 may be advantageous for older or disabled people who cannot bend down, or even for a physically able person who is playing catch with his or her dog and doesn't want to pick up a slobber-covered disc. In this method, as first illustrated in FIG. 10A, the front rail 122 may first be passed over one end of the disc 130, so that the disc 130 fits into the U-shaped opening of the front rail 122. As illustrated in FIG. 10B, the back rail 124 may then be pushed down, typically by the thrower's foot, over the opposite edge of the disc 130, thus fully inserting the disc 130 into the disc holder 120. Since the diameter of the disc 130 is generally larger than the open diameter of the disc launcher 100, some amount of force will be required to snap the second side (the back rail 124 in this example) of the disc holder 120 over the disc 130. In another embodiment, the disc 130 may be loaded into the back rail 124 first and then the front rail 122.

Figure 11A:
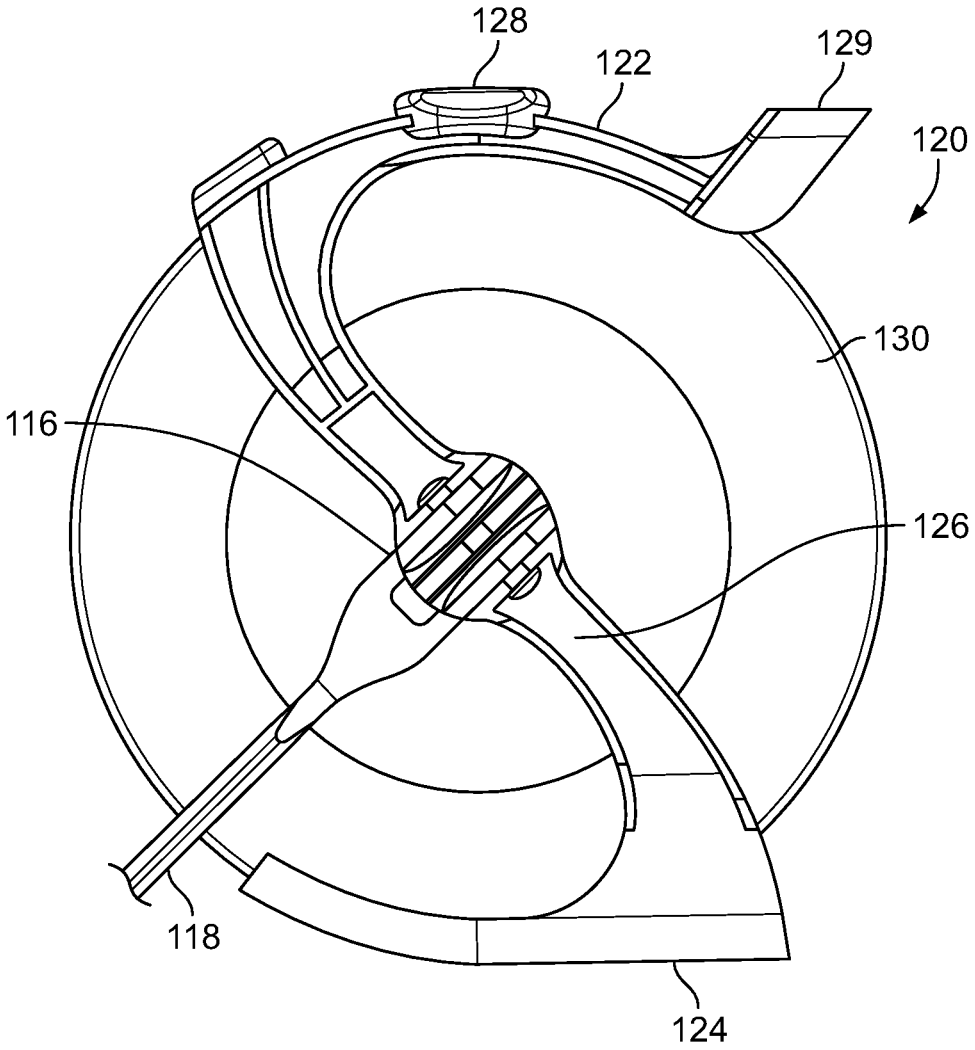
FIG. 11A is a top view of the distal portion of the disc launching device, with a disc loaded into it.

FIG. 11A shows the disc 130 loaded into the disc holder 120 of the disc launcher 100. FIG. 11B shows an alternative embodiment of a disc holder 170 for use with an alternative disc launcher. This embodiment includes a more slanted or angled front rail 172, in addition to the curved back rail 174 and top support member 176. As evidenced by this example, the disc holder 170 may have any of a number of different shapes and sizes, according to various alternative embodiments.

Figure 11C:
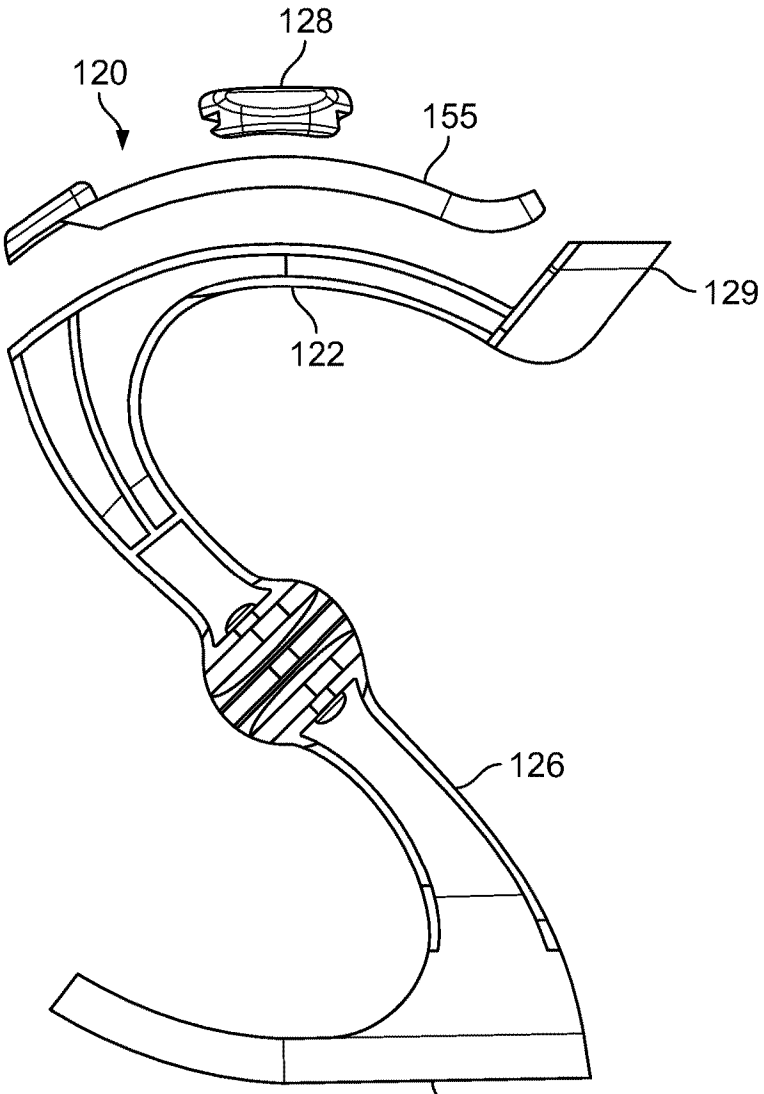
FIG. 11C is a top, partially exploded view of a disc holder of the disc launching device of FIG. 11A.
Figure 11B:
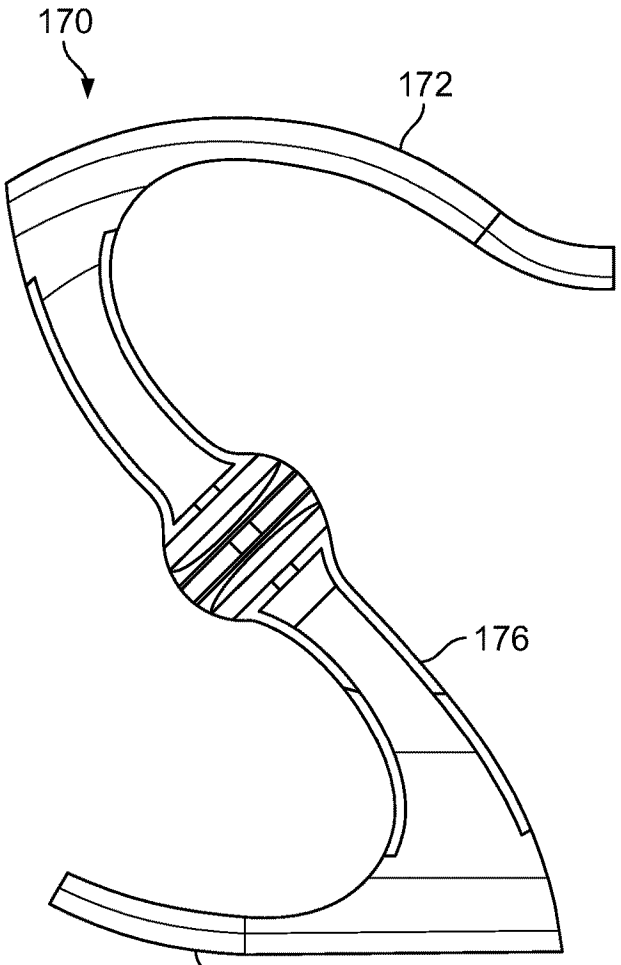
FIG. 11B is a top view of a disc holder of a disc launching device, according to another alternative embodiment.

FIG. 11C is a partially exploded view of the disc holder 120 of FIG. 11A. Here, the displacement member 155 is shown removed from the front rail 122. In this embodiment, the displacement member 155 is one piece.

Figure 11D:
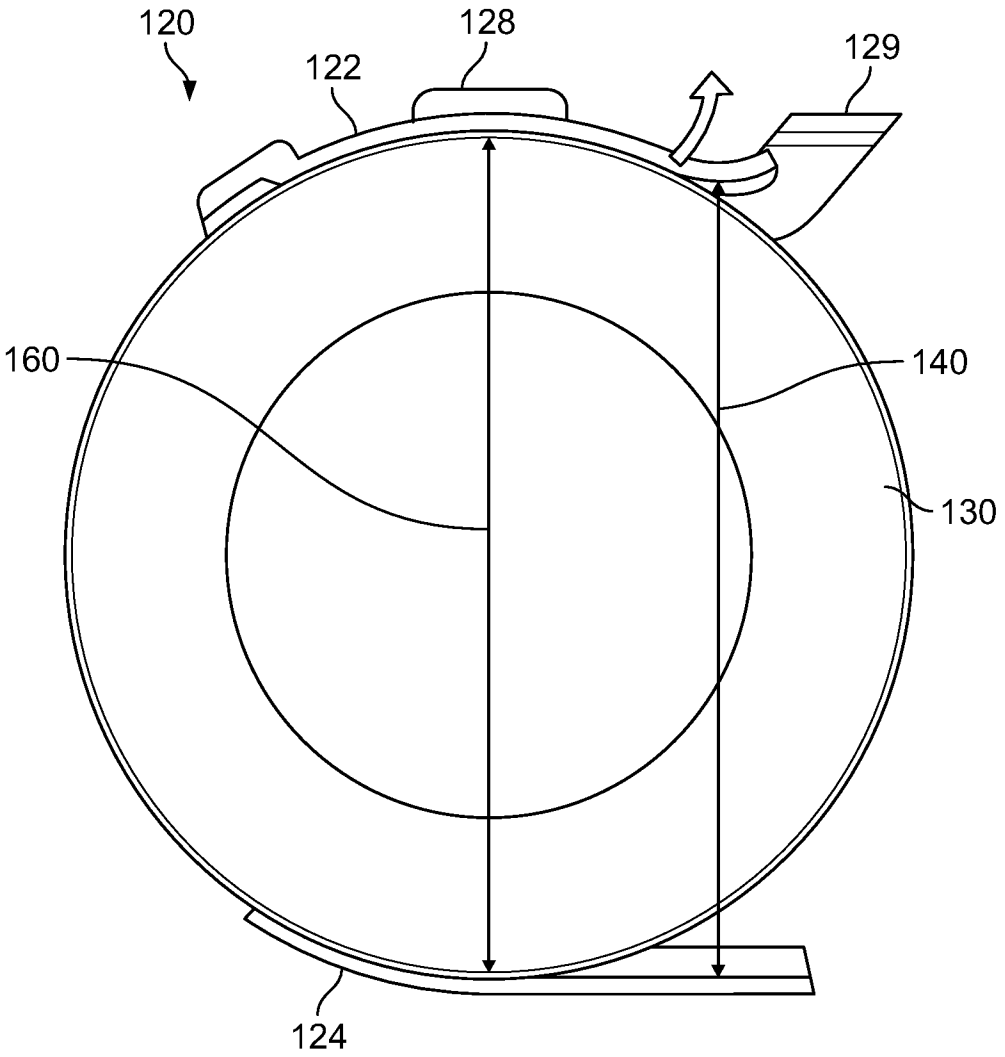
FIG. 11D is a top, partial cross-sectional view of the disc holder of FIGS. 11A and 11C, illustrating the diameter of the front opening relative to the diameter of the disc.

FIG. 11D shows the front opening diameter 140 and the disc diameter 160 of the disc holder 120. Again, the disc diameter 160 is larger than the front opening diameter 140, so the disc holder 120 must deflect in response to generated elastic potential energy, in order to launch the disc 130.

Figure 11E:
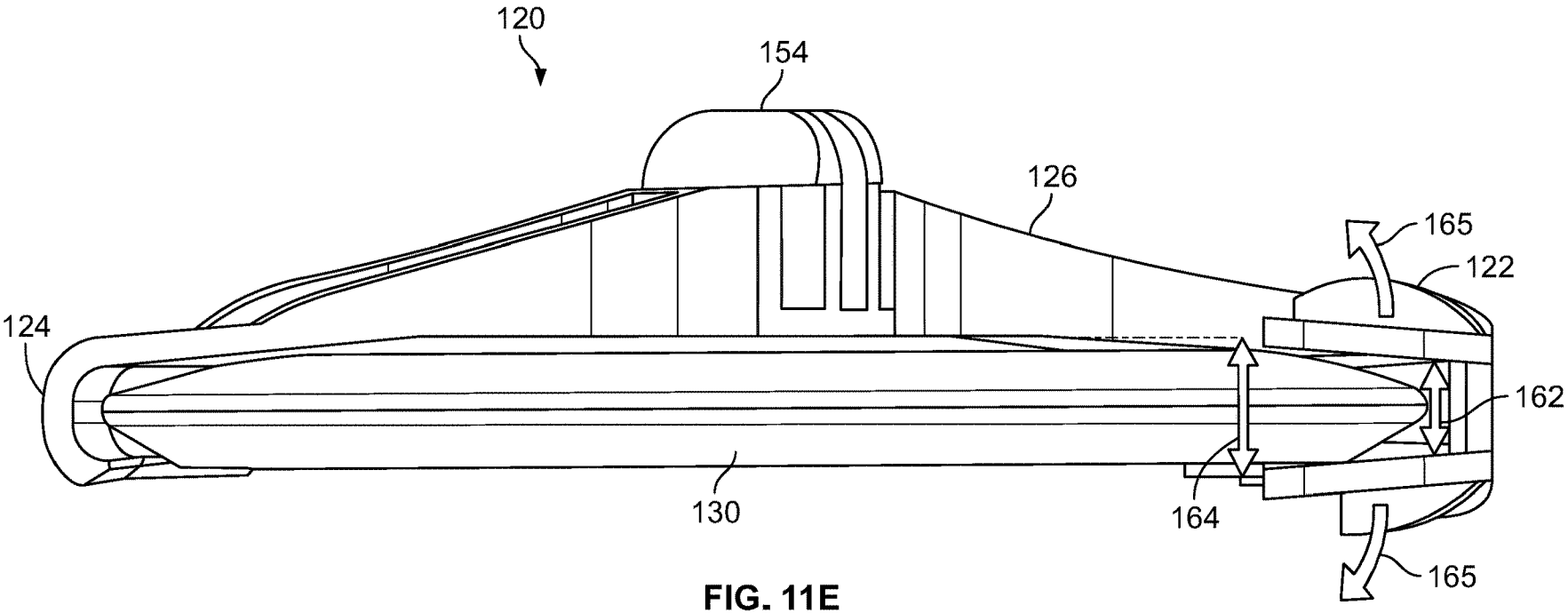
FIG. 11E is a front side view of the disc holder of FIGS. 11A, 11C and 11D, illustrating the with width of the front rail and the back rail and forces applied with the front rail and back rail to the disc.

FIG. 11E is a front side view of the disc holder 120. This view illustrates a height 162 of the opening in the front rail 122, which is likely the same as, or very similar to, a height of the corresponding opening in the back rail 124. The edges of the disc 130 fit into these U-shaped openings in the two rails 122, 124, and the edges then pass through the openings as the disc 130 is launched out of the disc holder 120. The height 162, when compared to a thickness 164 of the disc 130, accounts for the vertical or pinching force placed on the disc 130 by the front rail 122 and the back rail 124 to hold the disc 130. In order for the disc 130 to launch out of the disc holder 120, sufficient launching force must be applied to the disc 130 so that it displaces the top and bottom portions of the front rail 122 and the back rail 124. The displacement forces 165 are indicated by the curved arrows in FIG. 11E.

The above is a full and accurate description of various examples of a disc launching device, system and method. Although the description is thought to be complete, it is meant to describe examples only, and it is not meant to limit the scope of the following claims. Any number of additions or other modifications to the examples described above may be made, without departing from the scope of the claims.

We claim:

1. A method for launching a disc, using a disc launching device, the method comprising:

holding a grip end of a handle of the disc launching device;

loading the disc into a disc holder coupled with an attachment end of the handle at an opposite end of an elongate shaft of the handle, wherein the disc holder comprises:

a front rail for holding an edge of the disc;

a back rail for holding the edge of the disc across from the front rail;

a front opening having an opening diameter that is smaller than a diameter of the disc; and a back opening, wherein the disc is loaded into the back opening; and a top support member attached to and extending between the front rail and the back rail, wherein the attachment end of the handle is attached to the top support member at an oblique angle relative to the front opening;

rotating the attachment end of the handle about an axle that connects the attachment end to the disc holder, to move the handle relative to the disc holder from a loading configuration, in which a longitudinal axis of the handle is angled relative to a plane of the disc holder, to a throwing configuration, in which the longitudinal axis of the handle is parallel to the plane of the disc holder; and swinging the handle of the disc launching device with sufficient forward momentum to cause the disc to launch out of the front opening in the disc holder.

2. The method of claim 1, wherein loading the disc into the disc holder comprises sliding the disc into the back opening between the front rail and the back rail.

3. The method of claim 1, wherein the attachment end of the handle is attached to a middle of the top support member.

4. The method of claim 1, further comprising locking the handle relative to the disc holder in the throwing configuration with a locking member.

5. The method of claim 1, wherein swinging the handle of the disc launching device with sufficient forward momentum comprises deflecting a deflection member on a disc contact surface of the front rail to allow the disc to launch out of the front opening in the disc holder.

6. The method of claim 5, further comprising adjusting an adjustment member coupled with the front rail, to adjust an amount of force with which the deflection member holds the disc and thus adjust an amount of force required to be applied to the launching device to launch the disc.

7. The method of claim 6, wherein adjusting the adjustment member comprises sliding a slider along the front rail between a least force position and a greatest force position.

8. The method of claim 5, further comprising:

removing the deflection member from the front rail; and attaching a replacement deflection member to the front rail, wherein the deflection member and the replacement deflection member have different sizes to accommodate different sizes of discs in the disc launching device.

9. The method of claim 1, wherein the front rail is curved and the back rail is straight.

10. The method of claim 1, wherein each of the front rail and the back rail comprises a V-shaped inner surface for gripping the disc.

* * * * *